US012076654B2

(12) United States Patent
Comfort et al.

(10) Patent No.: US 12,076,654 B2
(45) Date of Patent: Sep. 3, 2024

(54) START AND END COMPONENTS AND METHODS OF MAKING SAME

(71) Applicant: Q-BA-MAZE Inc., Minneapolis, MN (US)

(72) Inventors: Andrew Comfort, Minneapolis, MN (US); Shane Rogers, Woodbury, MN (US); Lauren Johnson, Saint Paul, MN (US); Kristin Gallagher, Lino Lakes, MN (US)

(73) Assignee: Q-BA-MAZE Inc., Minneapolis, MN (US)

( * ) Notice: Subject to any disclaimer, the term of this patent is extended or adjusted under 35 U.S.C. 154(b) by 500 days.

(21) Appl. No.: 17/564,067

(22) Filed: Dec. 28, 2021

(65) Prior Publication Data

US 2022/0203216 A1 Jun. 30, 2022

Related U.S. Application Data

(60) Provisional application No. 63/131,302, filed on Dec. 28, 2020.

(51) Int. Cl.
*A63F 7/36* (2006.01)

(52) U.S. Cl.
CPC ..... *A63F 7/3622* (2013.01)

(58) Field of Classification Search
CPC ..... A63F 7/3622; A63F 7/04; A63H 18/00; A63H 18/02; A63H 18/06; A63H 18/08
See application file for complete search history.

(56) References Cited

U.S. PATENT DOCUMENTS

| | | | | | |
|---|---|---|---|---|---|
| 1,274,979 | A * | 8/1918 | Bliley | A63F 7/3622 | 273/120 R |
| 1,524,378 | A | 1/1925 | Antes | | |
| 1,724,447 | A * | 8/1929 | Abbott | A63F 7/3622 | 104/63 |
| D186,278 | S | 10/1959 | Dart | | |
| 2,988,361 | A | 6/1961 | Dart | | |
| 4,007,933 | A * | 2/1977 | Cooper | A63F 7/3622 | 273/445 |
| 4,260,155 | A * | 4/1981 | Jordan | A63F 7/3622 | 273/120 R |
| 4,713,038 | A * | 12/1987 | Wichman | A63F 7/3622 | 446/168 |

(Continued)

FOREIGN PATENT DOCUMENTS

| | | |
|---|---|---|
| KR | 20050006591 | 1/2005 |
| WO | 2006113741 | 10/2006 |
| WO | 2009036302 | 3/2009 |

OTHER PUBLICATIONS

International Search Report and Written Opinion for PCT Application No. PCT/US2021/065415, mailed Apr. 21, 2022 (21 pages).

(Continued)

*Primary Examiner* — Raleigh W Chiu
(74) *Attorney, Agent, or Firm* — Padda Law Group

(57) ABSTRACT

The present disclosure, in one embodiment, relates to a randomizer that includes a starter assembly and a collector. The starter assembly provides participants in a race with a fair start and also provides spectators with a beneficial view of the not only the start of the race, but in some cases, the race itself, including the finish.

20 Claims, 30 Drawing Sheets

(56) References Cited

U.S. PATENT DOCUMENTS

| | | | | | |
|---|---|---|---|---|---|
| 4,874,342 | A * | 10/1989 | Klitsner | A63F 7/3622 446/168 |
| D305,043 | S | 12/1989 | Klitsner | |
| D305,345 | S | 1/1990 | Klitsner | |
| 4,932,917 | A * | 6/1990 | Klitsner | A63F 7/3622 446/168 |
| 5,312,285 | A * | 5/1994 | Rieber | A63F 7/3622 273/109 |
| 5,549,295 | A | 8/1996 | Goldring | |
| 5,632,490 | A * | 5/1997 | Brown | A63F 7/048 273/350 |
| 5,782,378 | A * | 7/1998 | Hart | G07F 11/44 221/24 |
| 6,536,763 | B1 * | 3/2003 | Braun | A63F 7/3622 273/123 R |
| 7,798,494 | B1 * | 9/2010 | Benjamin | A63F 7/04 273/108 |
| 2002/0034982 | A1 * | 3/2002 | Mejia | A63F 7/3622 463/69 |
| 2002/0190463 | A1 * | 12/2002 | Duncan | A63F 7/3622 273/129 S |
| 2007/0060012 | A1 * | 3/2007 | Comfort | A63H 33/086 446/168 |
| 2013/0252506 | A1 * | 9/2013 | Ridinger | A63F 7/3622 446/168 |
| 2014/0017970 | A1 * | 1/2014 | Comfort | A63F 7/249 446/168 |
| 2022/0168627 | A1 * | 6/2022 | Jeong | A63F 7/02 |
| 2022/0203216 | A1 * | 6/2022 | Comfort | A63H 18/08 |
| 2022/0370889 | A1 * | 11/2022 | Ondov | A63F 3/0423 |
| 2024/0009551 | A1 * | 1/2024 | Textores, III | A63F 7/3622 |

OTHER PUBLICATIONS

Marble Run Racing Booster Set by Marble Genius Amazon product listing. Accessed on the Internet Mar. 30, 2022 URL: https://www.amazon.com/Marble-Genius-Run-Racing-Booster/dp/B08CVVLC9V/ref=asc_df_B08CVVLC9V/?th=1> (9 pages).

Marbleworks Grand Prix Racing Marble Run Discover Toys product listing. Accessed on the Internet Mar. 30, 2022 URL: <https://www.discoverytoys.US/products/marbleworks-r-grand-prix> (6 pages).

Jelle's Marble Runs YouTube Channel. Accessed on the Internet Mar. 30, 2022 URL: < https://www.youtube.com/channel/UCYJdpnjuSWVOLgGT9flzL0g> (5 pages).

Discovery Toys Marbleworks Marble Run Starter Amazon product listing. Accessed on the Internet Mar. 30, 2022 URL: <https://www.amazon.com/MARBLEWORKS-Marble-Starter-Discovery-Toys/dp/B003SAM6BU/ref=sr_1_1_sspa?> (11 pages).

Marble Race: Marble League 2019 Qualifiers YouTube video posted Jan. 26, 2019 by Jelle's Marble Runs. Accessed on the Internet Mar. 30, 2022 URL: <https://www.youtube.com/watch?v=O2AbcCbyJ2U> (4 pages).

Fubeca's Marble Runs YouTube Channel. Accessed on the Internet Mar. 30, 2022 URL: < https://www.youtube.com/c/FubecasMarbleRuns> (3 pages).

M&H Racing YouTube Channel. Accessed on the Internet Mar. 30, 2022 URL :<https://www.youtube.com/c/EvaristeWK> (3 pages).

PlayGo Marble Race Deluxe Building 100-Piece Amazon product listing. Accessed on the Internet Mar. 30, 2022 URL: <https://www.amazon.com/PlayGo-Marble-Deluxe-Building-100-Piece/dp/B001HZBRO0> (9 pages).

Zoom Rails Wooden Marble Track Oriental Trading product listing. Accessed on the Internet Mar. 30, 2022 URL: <https://www.mindware.orientaltrading.com/zoom-rails-wooden-marble-track-a2-68490.fltr> (4 pages).

95 Pcs Marble Run Building Blocks Bricks Set for Kid Amazon product listing. Accessed on the Internet Mar. 30, 2022 URL: <https://www.amazon.com/dp/B09GVBG8YS/ref=sbl_dpx_toys-building-marble-sets_B099MQN2MG_0> (7 pages).

Quercetti Migoga Race Marble Run Toy Amazon product listing. Accessed on the Internet Mar. 30, 2022 URL: <https://www.amazon.com/Marble-Run-Glow-Glitter-Pieces/dp/B00207T5MA> (7 pages).

Ocean Marble Run Unboxing YouTube video posted Jul. 31, 2020 by Specialties Games, Toys, Gifts. Accessed on the Internet Mar. 30, 2022 URL: <https://www.youtube.com/watch?v=3YQH8yQbAg8&t=126s> (4 pages).

Marble Run Toy by Quercetti Migoga Race \\ Nico and Matthew play the Migoga Race Marble Run YouTube video bosted Oct. 2, 2021 by Pineda Tv. Accessed on the Internet Mar. 30, 2022 URL: <https://www.youtube.com/watch?v=0xr0gJkHjT0> (4 pages).

Reference images compiled by inventor Shane Rogers during product development and last modified Jun. 17, 2020 (21 pages).

* cited by examiner

START AND END COMPONENTS AND METHODS OF MAKING SAME

CROSS REFERENCE TO RELATED APPLICATION

The application claims priority to U.S. Provisional Application No. 63/131,302, titled, "Start and End Components and Methods of Making Same," filed on Dec. 28, 2020, which is hereby incorporated herein in its entirety.

FIELD OF THE INVENTION

The present disclosure relates to randomizers for use in games and other endeavors. In some embodiments, the present disclosure relates to marble run toys with randomizers that may include one of a start and/or end component. In more particular embodiments, at least one of the start and/or end component provide a fair competition for all participants, in addition to providing spectators with an optimal view of at least the start of the race.

BACKGROUND OF THE INVENTION

The present disclosure relates to innovative racing games and apparatuses. Starting lines have a relationship to the finish line of the race and to the racecourse which exists between start and finish. Typically, in races in which animate or inanimate participants compete, it is desirable for the start to be physically and/or geometrically arranged in an attempt to create relative fairness for all participants regardless of which start position any of the various participants may have. However, in practice, actual fairness based on starting position, related finish position and the course in between the two is not fair for each participant. For example, often the start for races is arranged as a straight line along which the participants are arrayed in a single row, several rows, a jumbled grouping, or a combination of these, none of which results in a fair race for each participant.

Further, races are typically conducted with the expectation that spectators will watch the race. Thus, ideally, the start, finish, and the course in between would be configured to maximize spectator appreciation of the race. Various features of races and racecourses can be, but are often not, arranged to increase the excitement and anticipation for both participants and spectators by affording opportunities for the order of the participants to change during the course of the race. The anticipation is finally resolved at the finish line where a final ranking of the participants is established. Because racing games and competitions are a staple of human enjoyment, a need exists for an improved way to ensure a fair start and/or finish to the race that increases participant and spectator excitement.

BRIEF SUMMARY OF THE INVENTION

The present disclosure, in one embodiment, relates to a launcher for a race game. The launcher includes a bowl that includes a dedicated starting position for each of at least three orbs. The bowl has an inner surface and an outer surface, and the inner surface defines a bowl shape. The bowl also has an opening in the inner and outer surfaces that is large enough for the at least three orbs to fit through one at a time. Three of the starting positions together form the points of a triangle in plan view, and the opening is lower than a horizontal plane of the lowest point of the triangle.

In some embodiments, the launcher also includes at least three dedicated starting positions that together form three points of a triangle in plan view, wherein the opening is within the triangle in plan view. In some embodiments, the triangle is an equilateral triangle in plan view. In some cases, the opening is centered under the equilateral triangle in plan view. In other embodiments, the launcher has three dedicated starting positions that form three points of a triangle in plan view, where the opening is not within the triangle in plan view.

In some embodiments the launcher bowl is a vortex. In other embodiments, the bowl is a cone.

In some embodiments, the launcher as an opening that allows for more than one orb or marble to fit through at a time.

In other embodiments, the present disclosure includes a launcher for a game, where the launcher includes a first portion that includes a dedicated starting position for each of at least three orbs. The launcher also includes a second portion attachably coupled below the first portion, wherein the second portion has an inner surface and an outer surface, and where the inner surface defines a bowl shape. The second portion has an opening in the inner and outer surfaces that is large enough for the at least three orbs to fit through one at a time, and three of the starting positions together form the points of a triangle in plan view.

In some embodiments, the launcher also includes a path of the same distance from each of the dedicated starting positions to the opening.

In some embodiments, the launcher has an opening that is within the triangle in plan view. In some cases, in plan view the triangle is equilateral. In some embodiments, the opening is centered under the plan view equilateral triangle.

In another embodiment, the present disclosure includes a randomizer for game play, where the randomizer includes a bowl communicably coupled to one or more finish pathways that lead to at least three finish positions. In this embodiment, the bowl includes a dedicated starting position for each of at least three orbs, and the bowl has an inner surface and an outer surface, where the inner surface defines a bowl shape. The bowl has an opening in the inner and outer surfaces that is large enough for the at least three orbs to fit through one-at-a-time. The at least three dedicated starting positions together form three points of a triangle in plan view, and the one or more finish pathways that lead to at least three finish positions includes a finish position for a first-arriving orb.

In some embodiments, the randomizer includes a single finish pathway that displays the at least three orbs in the order in which they arrive.

In some embodiments, the opening is within the triangle in plan view. And in some cases, the opening is centered under the triangle in plan view.

In some embodiments, the launcher further includes at least three dedicated starting positions that form three points of a triangle in plan view, where the opening is not under the triangle in plan view.

In some embodiments, at least one modular member is detachably connected in between the bowl and the finish pathway. In some embodiments, the randomizer includes a finish pathway that is formed in a base that is at least four times the width of the at least one modular member.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

Figure 1:
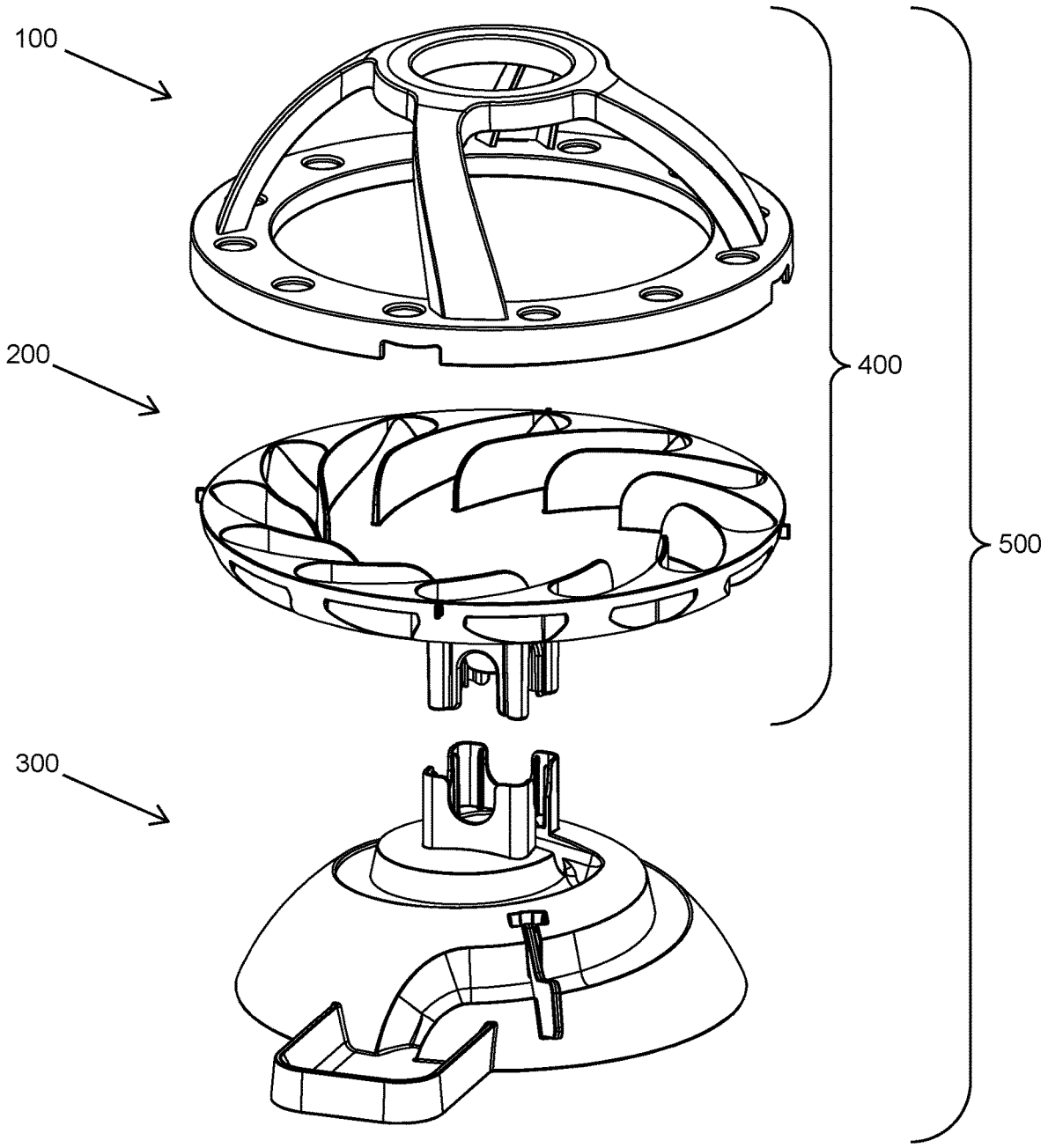
FIG. 1 illustrates a perspective view of the first component, the second component and the collector vertically aligned in an exploded arrangement, in accordance with one embodiment.

As previously stated, various features of races and racecourses can be, but are often not, arranged to increase the excitement and anticipation for both participants and spectators. Because racing games and competitions are a staple of human enjoyment, a need exists for an improved way to ensure a fair start and/or finish to the race that increases participant and spectator excitement.

Rather than a starting line, various embodiments of the present invention may have a starting perimeter. The participants, which could be people, animals or objects, such as spheres, orbs, or marbles, for example travel along a perimeter and race toward one another and an exit opening within the perimeter. While various embodiments are described herein as using marbles, it should be understood that any other type of race participant may alternatively be used in any of these embodiments. Rolling objects may be particularly useful such as balls and wheeled objects such as toy cars. There may optionally be further travel above, below, beyond or outside the starting perimeter, before entering and/or after exiting the perimeter. In some embodiments, the race begins at the perimeter with the perimeter acting as a starting perimeter. The starting perimeter may be a circle and the starting positions may be arranged in equidistant positions around the diameter of this circle. In some embodiments, the exit opening may be in the geometric center of the circle thus providing an equality to the path of any of the participants from starting position to the exit opening.

Various embodiments of the present disclosure may be a standalone gaming device, an accessory to a modular pathway apparatus and/or all of its accessory components, or may be the same component used in all of these ways. Various embodiments of the present invention together with the apparatus and its other accessories contains a beguiling complexity, while still being easily accessible and usable. It may be one or more of a toy and a game, a science experiment and a kinetic sculpture, and/or a diversion and brain exercise. Different components of some embodiments of the present disclosure, including, but not limited to, for example, modular members, cubes, and/or other various accessories may be combined to create endless opportunities for experimental play in three spatial dimensions, as well as a fourth dimension—time. In some embodiments, the present disclosure addresses several fields both separately and in various combinations. These fields include, but are not limited to racing, randomization, games, modular construction, marble runs, and STEM/STEAM education. Embodiment of the present disclosure may be used for solo or collaborative play, at home or in the classroom, for following step-by-step plans or for open-ended experimentation. Some embodiments may be part science and part art. Embodiments of the present disclosure may be a tool for experiential learning through play.

In some embodiments, curiosity about the eventual finish position of the marbles may be central to play with the interconnecting modular pathway apparatus. The pathways may continually diverge and converge and then diverge and converge again. Marbles may dawdle and then sprint ahead. The interior geometry of the parts may contribute to this erratic and unpredictable behavior. Sometimes a dawdling marble may get going again of its own volition and for example, be ricocheted in an unexpected direction by another marble tumbling in from above. Other exciting and unpredictable events may occur. For example, when two marbles occupy a double-exit modular member, often they exit out opposite sides, but not always. They may exit the same side. Sometimes two marbles may even stop in a tenuously balanced equilibrium, gravity compelling each downward but each pushing the other back up the sloping floor of the modular member. The stalemate may be broken by a jostling of the structure or by entry of a third marble into the modular member which adds new energy, disrupts the equilibrium, and sends all three marbles on their way down the configuration.

Every component or feature of a given embodiment of the present disclosure that divides a pathway introduces uncertainty. Every component that allows multiple marbles to enter, simultaneously or sequentially, jostle with one another while inside and then exit at different times, increases the opportunities for change and the diversion of pathways. Configurations of the modular members and accessories may be built and rebuilt in response to the results of test runs of marbles through such configurations.

The question of final destination may get answered with a special member that establishes a clear ranked order for the marbles. However, the start may be an integrally important part of this question in some embodiments. Curiosity and anticipation is heightened by a starting arrangement that gives no advantage to one participant over another, gives no initial guess as to which participant, such as which marble may have a greater likelihood of winning because of somehow being ahead before the race even begins. The implementation of a fair start may be to make a compelling race with heightened anticipation for the spectators.

Marble Race Configuration and Randomizer. Various embodiments of the present invention as shown in, for example, FIGS. 12 to 14 include a modular pathway apparatus configured as a marble race configuration 600 in which a plurality of marbles starting at the top of the apparatus, from positions of equal advantage (or otherwise positioned as discussed regarding marble choreography below), race downward with multiple chances for passing, colliding, diverging onto separate pathways, converging back together and ultimately stopping at the bottom in a ranked finish order. At the top of the configuration 600 may be a starter accessory, which may be referred to as a launcher 400 and at the bottom may be a marble collector 300 that in some embodiments works as a sole sturdy footing for an entire configuration such as the marble race configuration 600. The collector may also be referred to as a base, a finish tray, etc. In between the starter 400 and collector 300 may be one or more modular member cubes or objects, for example, multiple modular single-exit cubes 910 and/or multiple modular double-exit cubes 930, or other parts and accessories. In some cases, the starter accessory 400 and/or the marble collector 300 may be combined with one or more other accessory pieces such as, but not limited to, the vortex 970 and the rails 980.

Other marble race toys which split and converge pathways are difficult to pick up and move from place to place, as some lack proper joinery between elements or require too many separate footings to provide balance. In contrast, various embodiments of the present disclosure may include secure joinery and optionally a single base footing 300 in some embodiments and can easily be picked up and moved from place to place, such as from the floor where it may be played with to a shelf where it may be stored.

Figure 3:
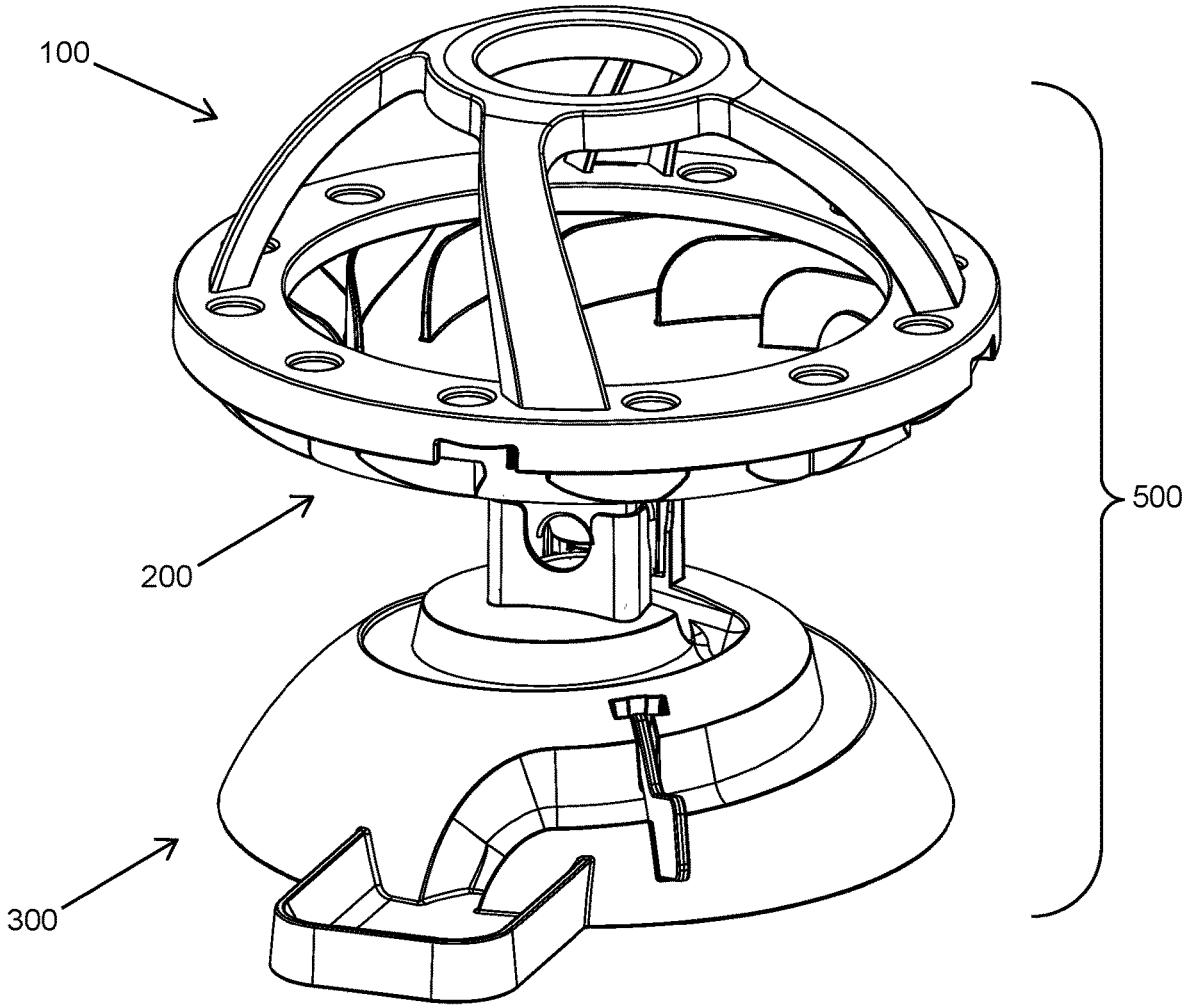
FIG. 3 illustrates a perspective view of the randomizer, in accordance with one embodiment.

An embodiment of the present invention as shown in FIG. 3, for example, may also act simply as a randomizer 500. The randomizer in some embodiments may be thought of as a very short race. Conversely, a configuration like the marble race configuration 600 can be thought of as a very slow randomizer which requires a longer time to deliver a result. With a configuration such as the randomizer 500 of FIG. 3, a plurality of marbles starting at the top, from positions of equal advantage, in any order or no particular order in the starter accessory 400, may be simultaneously released to roll downward, collide, scramble, and then line up in ranked order on the marble collector 300. This randomizer can be used in any suitable type of race or game play for the introduction of luck. It is also a fascinating diversion to just load with marbles and see how they sort out at the bottom.

Figure 25:
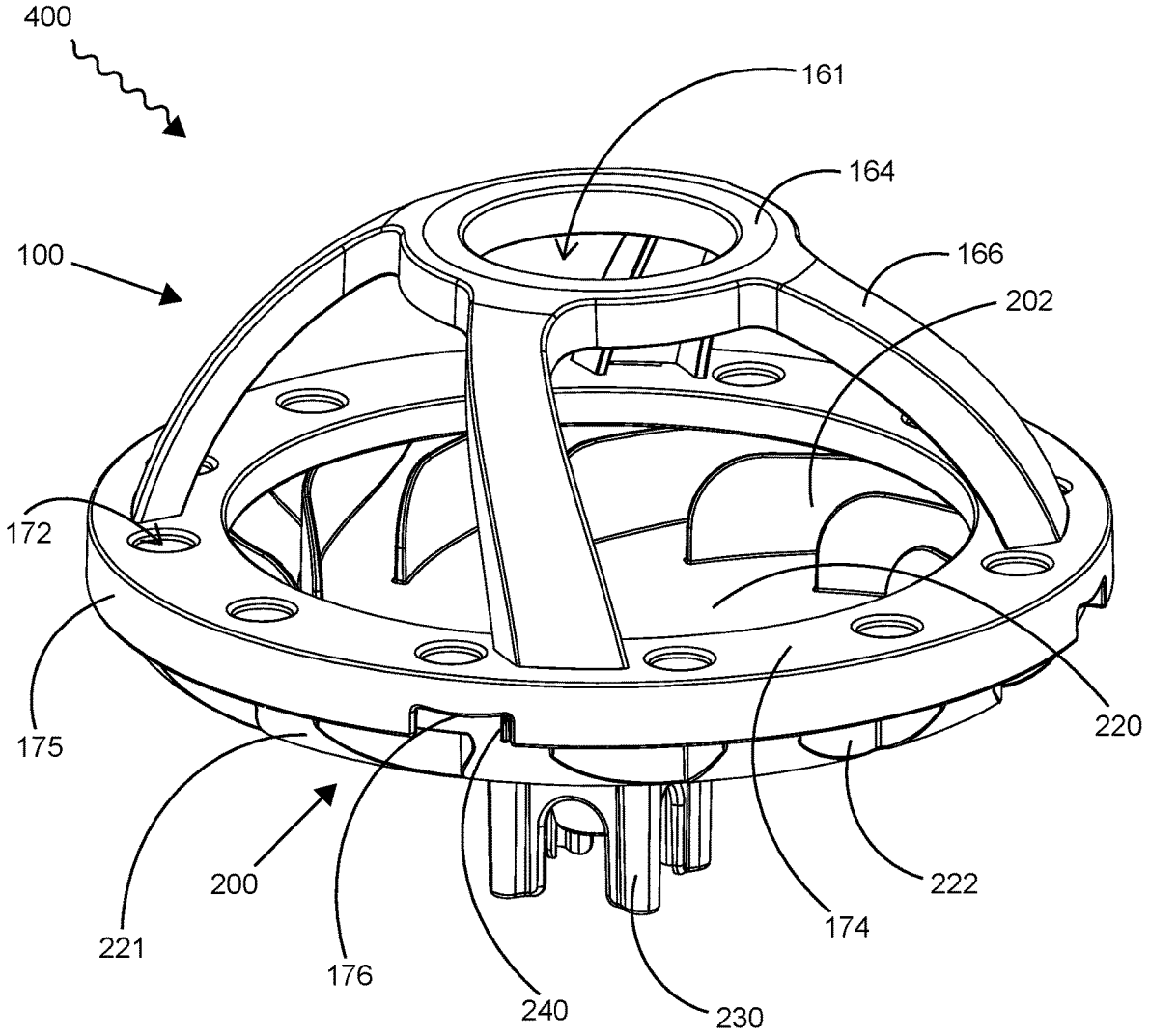
FIG. 25 illustrates a perspective view of the starter assembly, in accordance with one embodiment.
Figure 26:
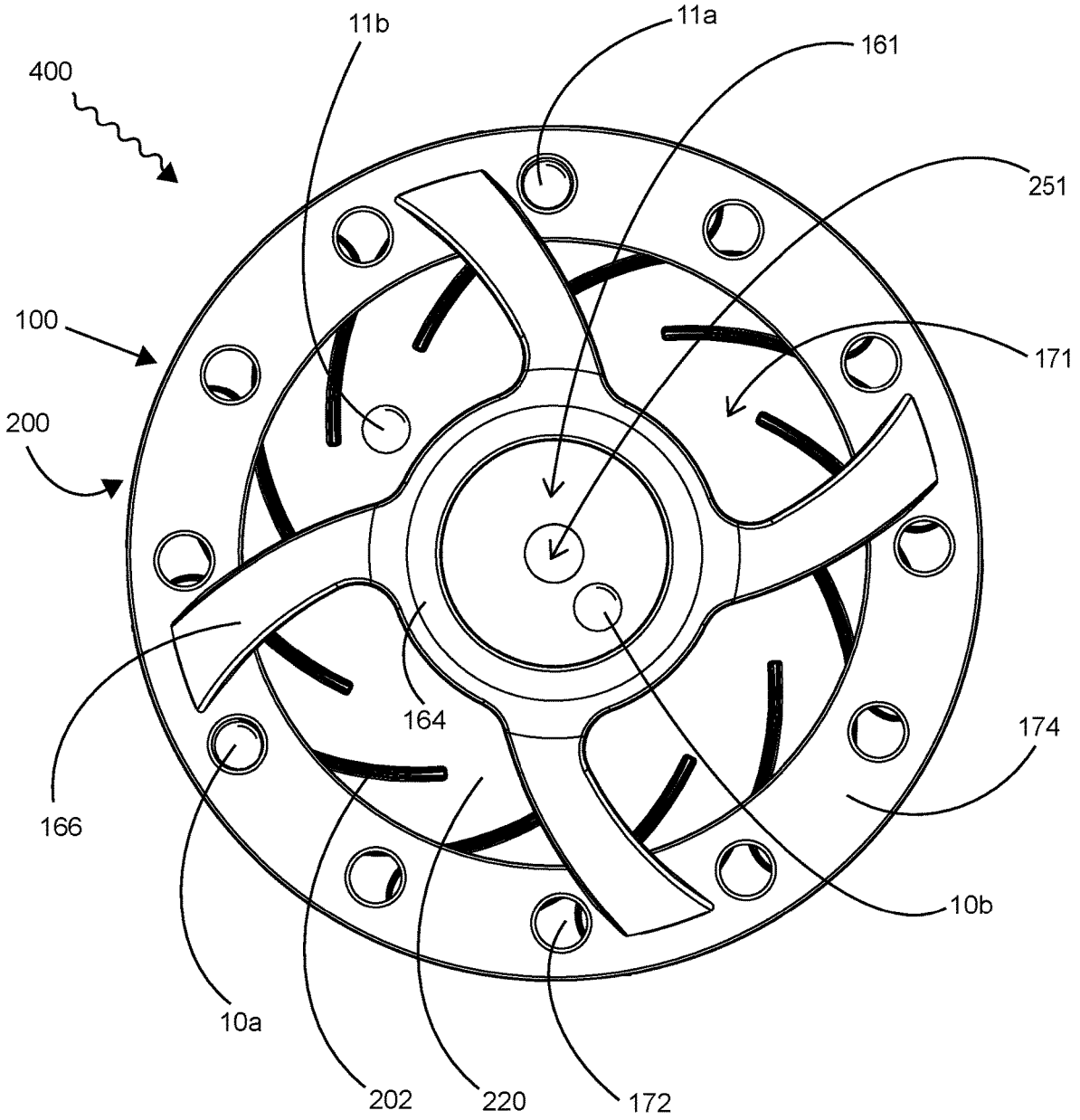
FIG. 26 illustrates a plan view of the starter assembly, in accordance with one embodiment.
Figure 27:
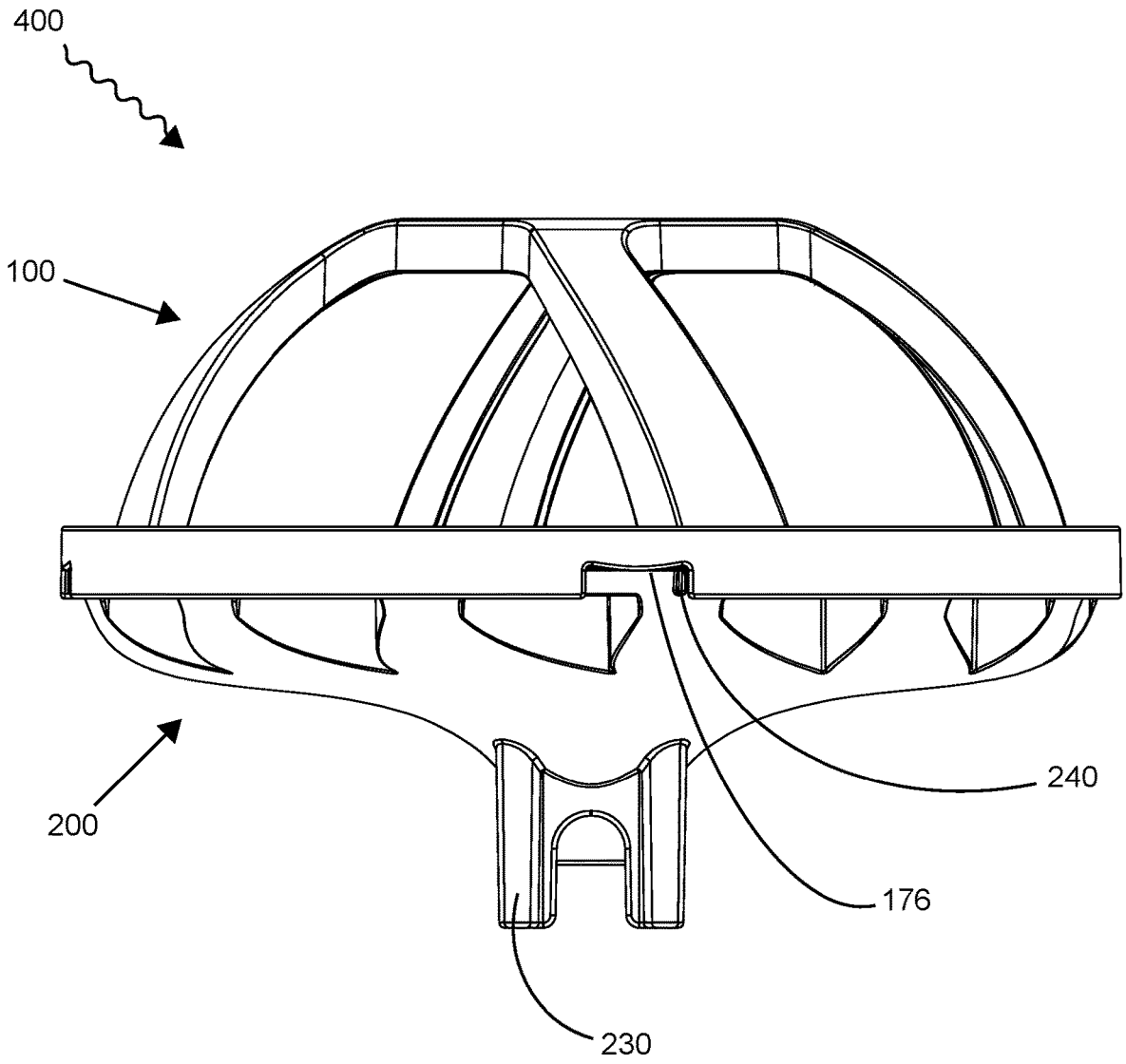
FIG. 27 illustrates an elevation view of the starter assembly, in accordance with one embodiment.

FIGS. 25 to 27 show an example of a starter accessory or launcher 400 including a first component 100 and a second component 200. The second component may be or may also be referred to as a bowl, or a bowl-shaped device and/or perimeter, for example. FIG. 1 shows an exploded view of the starter accessory 400 pulled apart into a first component 100 and a second component 200 with the collector base 300 below.

Figure 4:
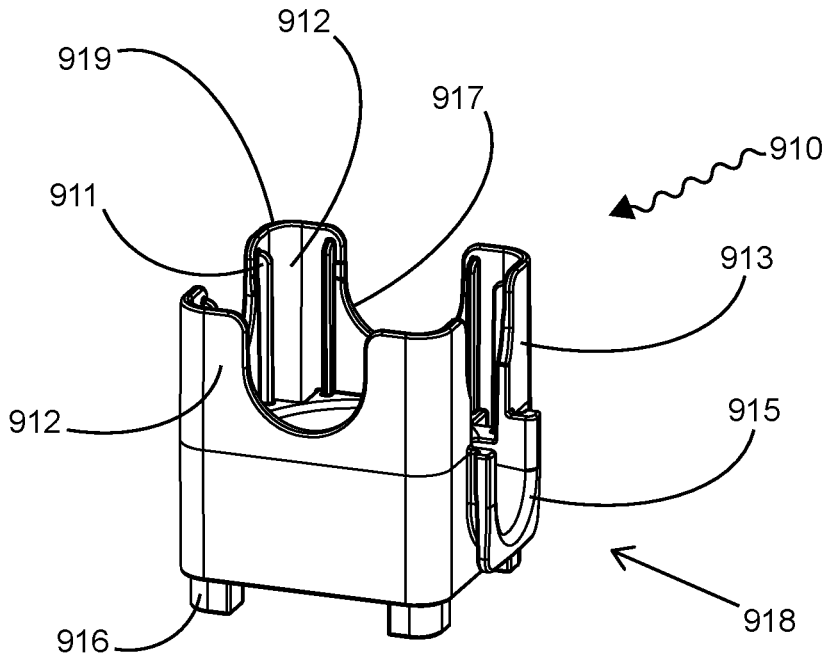
FIG. 4 illustrates a perspective view of a modular single-exit cube, in accordance with one embodiment.
Figure 5:
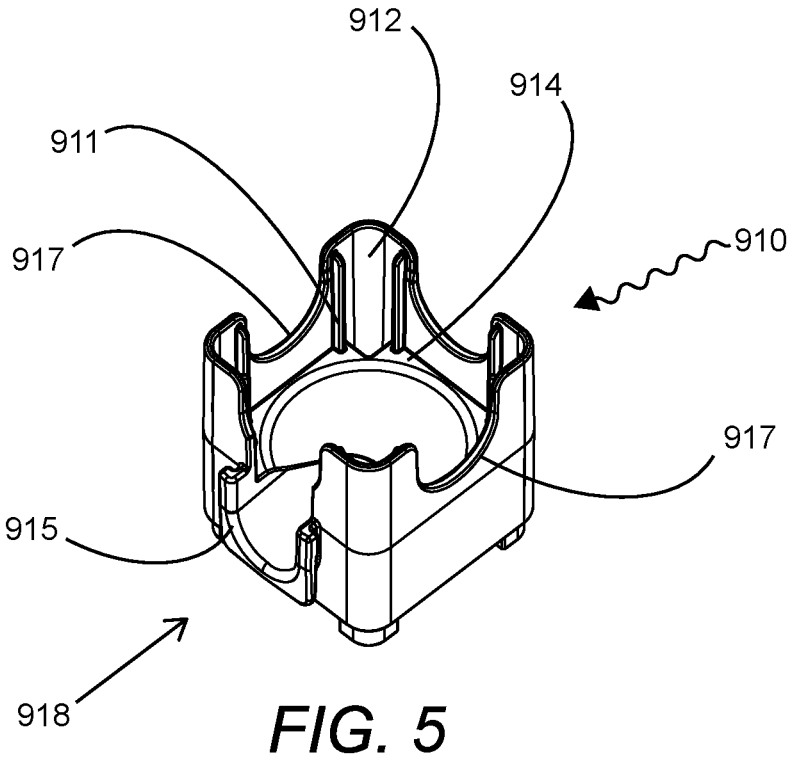
FIG. 5 illustrates another perspective view of a modular single-exit cube, in accordance with one embodiment.
Figure 6:
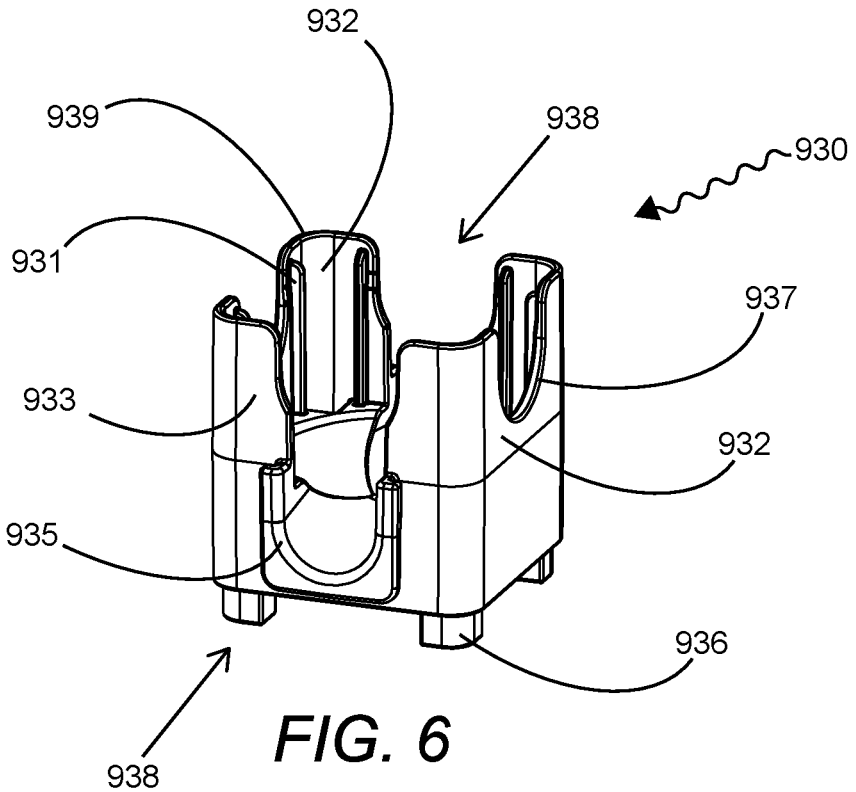
FIG. 6 illustrates a perspective view of a modular double-exit cube, in accordance with one embodiment.
Figure 7:
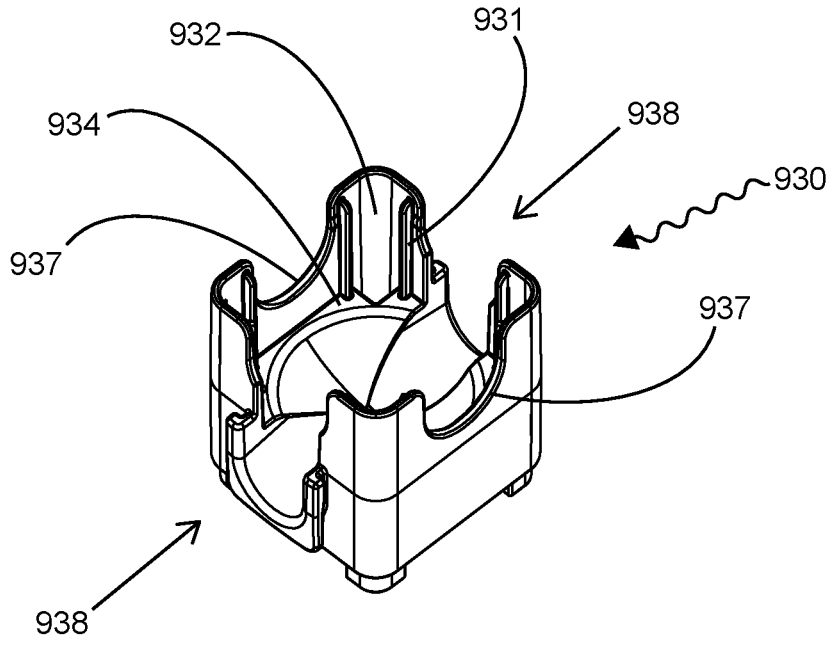
FIG. 7 illustrates another perspective view of a modular double-exit cube, in accordance with one embodiment.
Figure 8:
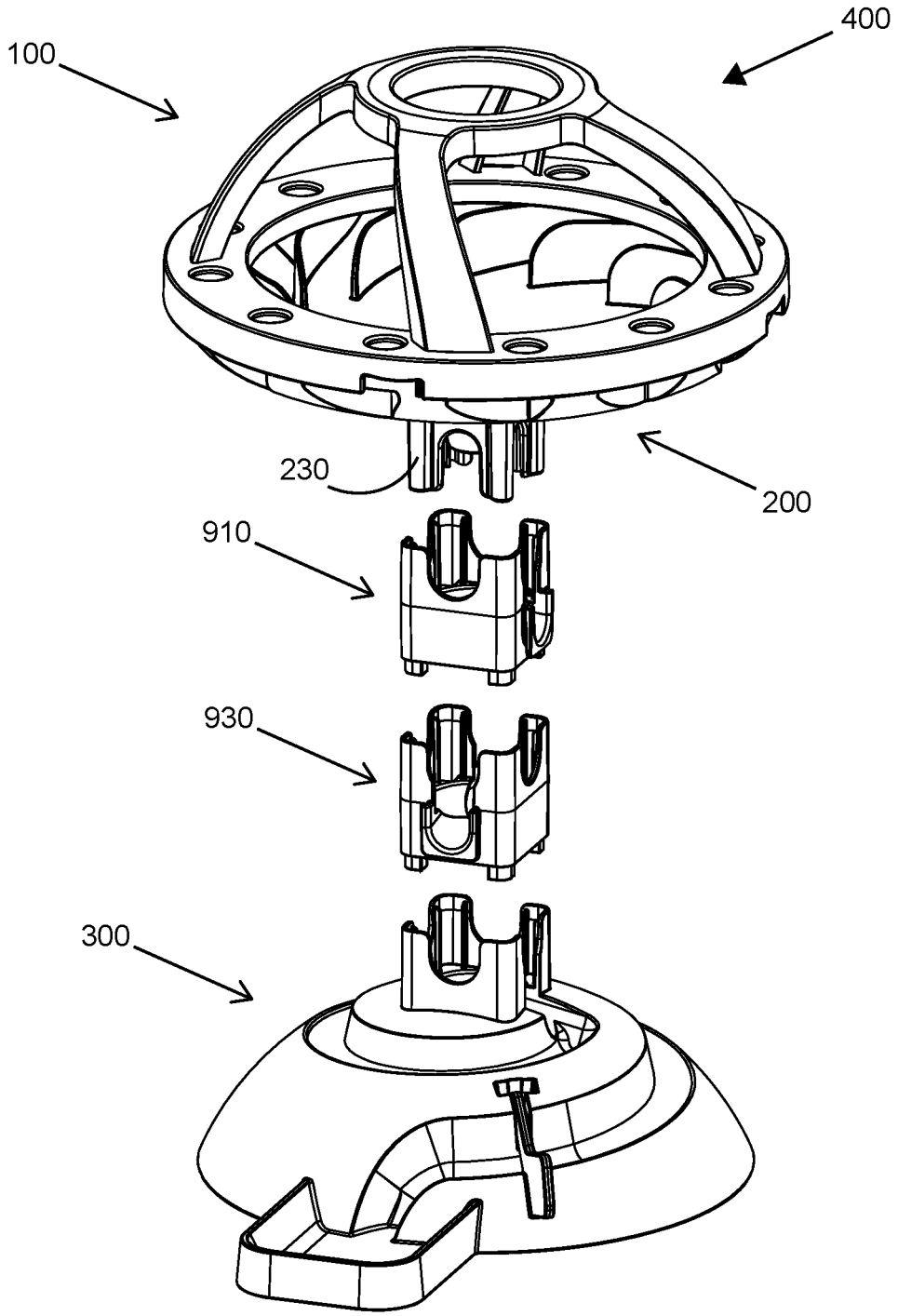
FIG. 8 illustrates a perspective view of the starter assembly, a single-exit cube, a double-exit cube and the collector vertically aligned in an exploded arrangement, in accordance with one embodiment.
Figure 9:
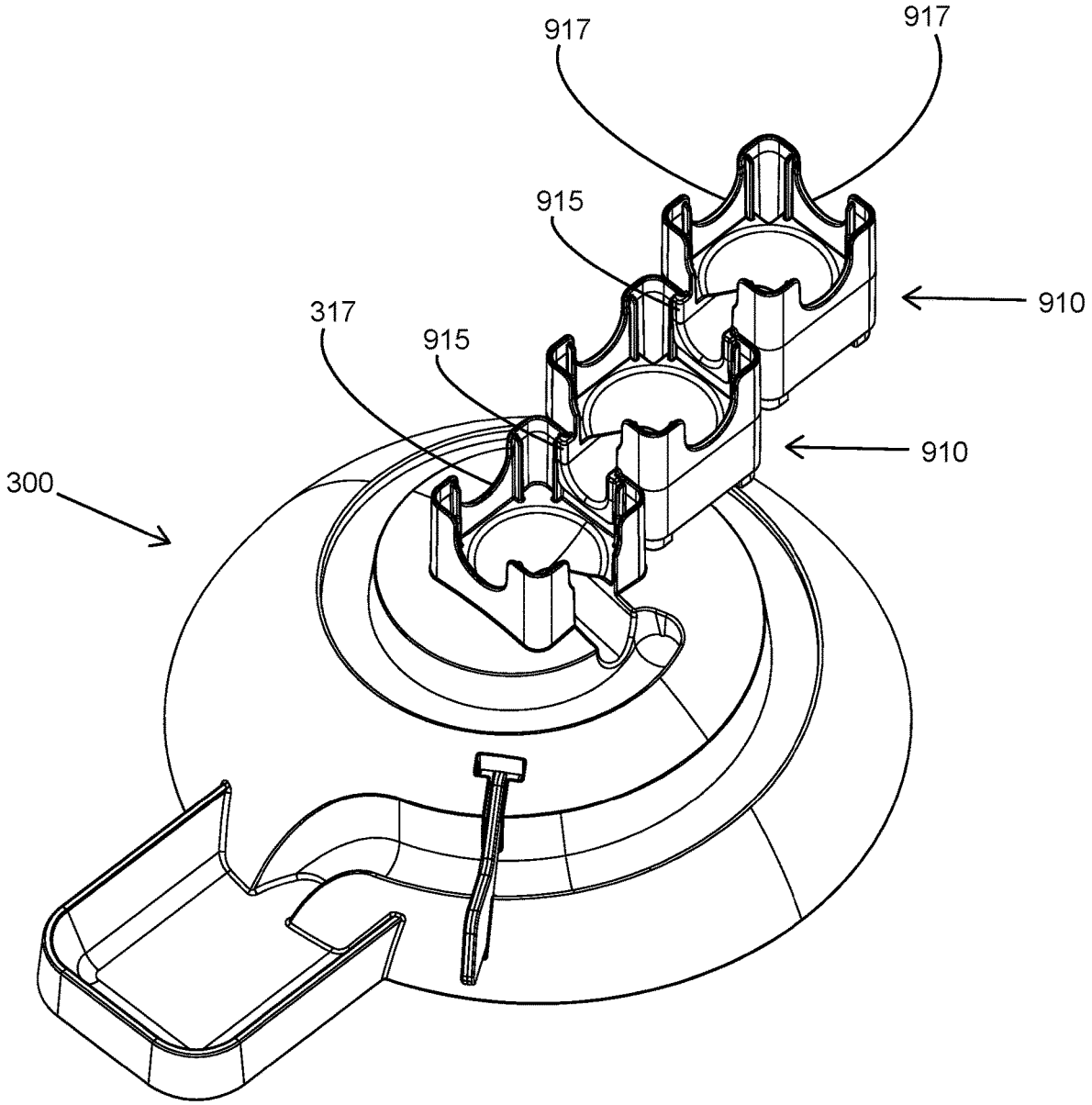
FIG. 9 illustrates a perspective view of two single-exit cubes connected to one another in a cascade pattern and further connected to the collector, in accordance with one embodiment.
Figure 10:
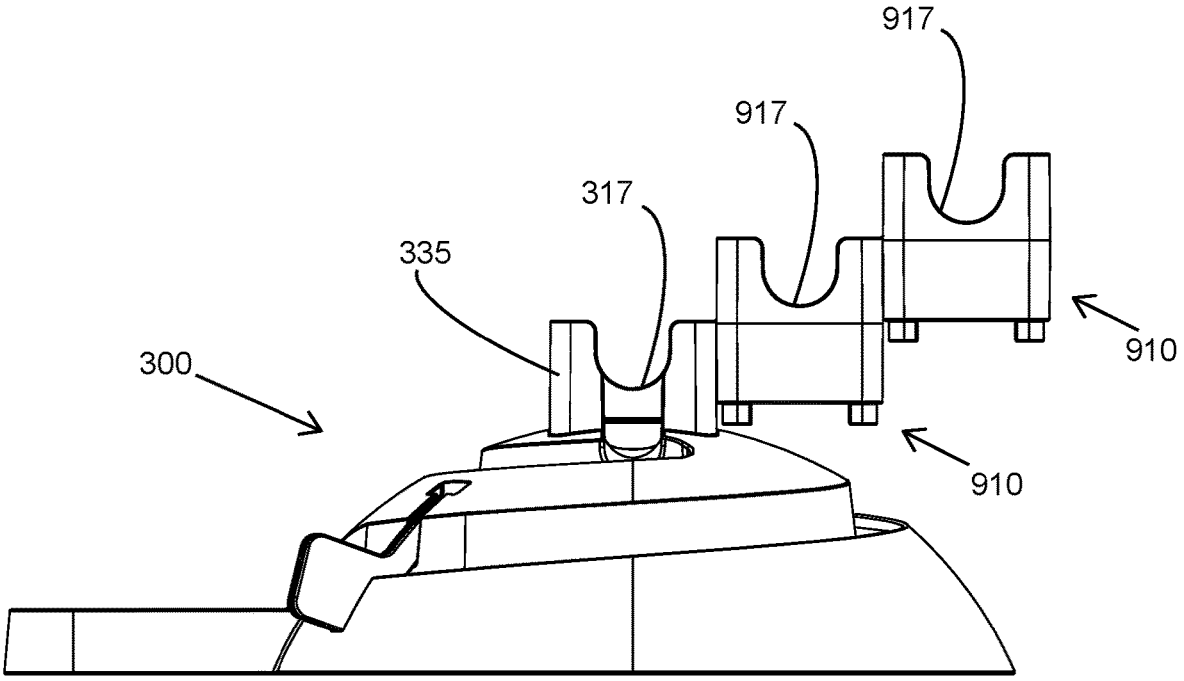
FIG. 10 illustrates an elevation view of the same configuration from FIG. 9 of two single-exit cubes connected to each other and to the collector, in accordance with one embodiment.
Figure 11:
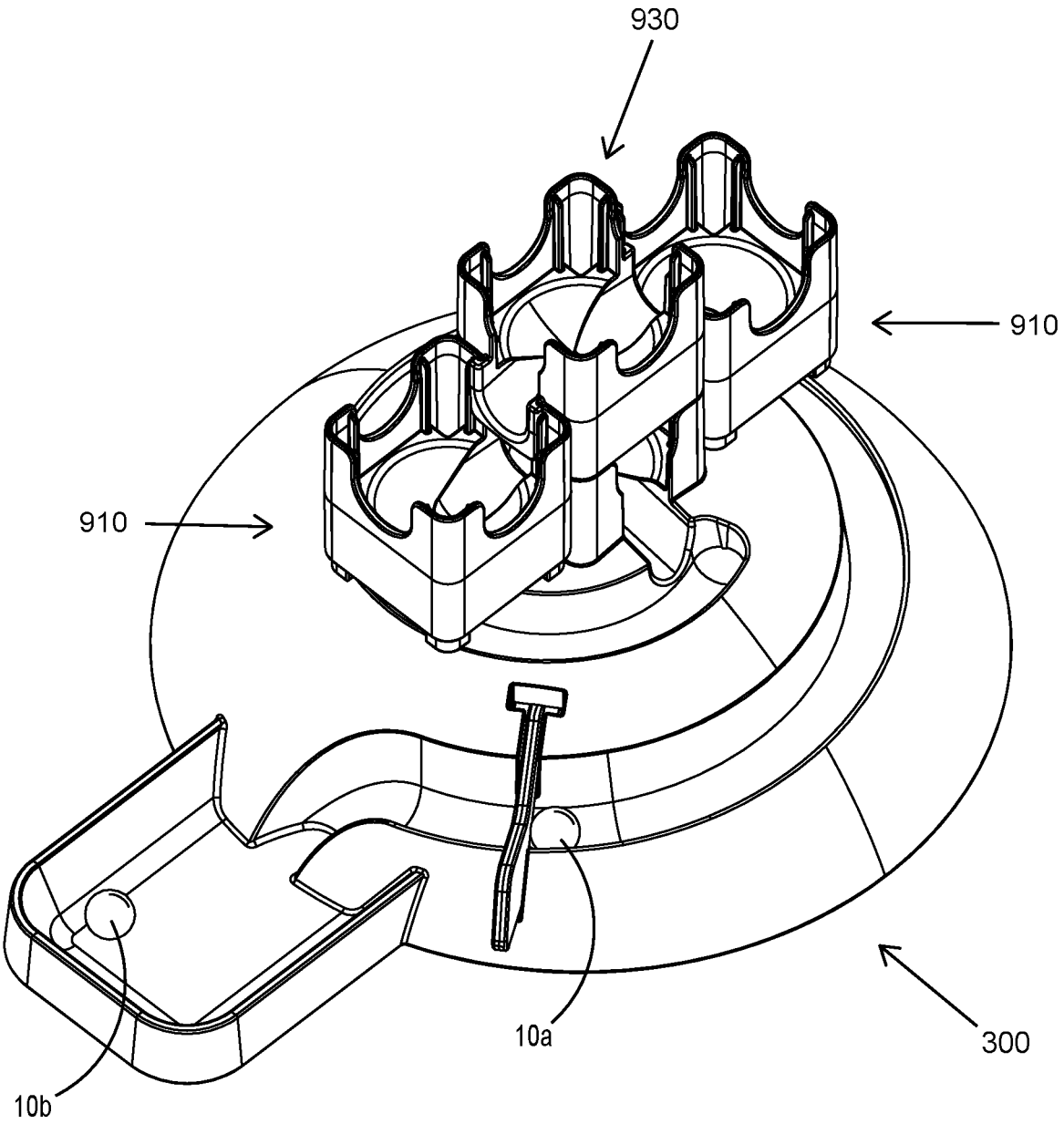
FIG. 11 illustrates a perspective view of two single-exit cubes connected on opposing entries of the collector with a double-exit cube, vertically aligned with and stacked upon the collector, the double-exit cube also connected to each of the two single-exit cubes, in accordance with one embodiment.

FIGS. 4 and 5 provide two isometric views of a modular single-exit cube and FIGS. 6 and 7 provide two isometric views of a modular double-exit cube. In practice, any number of modular cubes or modular members or other accessories may be included between the starter accessory 400 and the collector base. FIG. 8, for example, provides a schematic blown apart view of how two modular cubes 910 and 930 can optionally fit between a starter accessory 400 and a collector base 300, though in this schematic stacked configuration the side exit pathways of the modular cubes do not connect to another component. FIG. 11 shows how two single-exit cubes 910 may connect on opposite faces of a collector base 300 and how a double-exit cube 930, in turn, may stack directly on top of the collector base 300 while also connecting to the two single-exit cubes 910. This configuration of three modular cubes connected to the collector base 300 is a detail of the exact same pattern as used in the bottom of the configuration 600 of FIGS. 12 to 14. FIGS. 9 and 10 show two successive single-exit cubes 910 cantilevering out one direction from a collector base 300. Other configurations and numbers of modular cubes may alternatively be used.

A racecourse made using the modular members can be devised in which there is just a single track or pathway with no splitting into multiple separate tracks or pathways. With the use of double-exit modular cubes or other members that provide more than one exit pathway, multiple courses between top and bottom are possible. Such multiple intersecting and intermingling courses may diverge and converge, and diverge and converge, and over and over again as multiple pathways may converge on any of the modular cube members and other members and accessories that work with the modular pathway apparatus.

Race configurations with a mix of very slow and very fast courses are possible. For example, a very slow course could have many double-exit modular members and thus many chances for a marble to pause and rock back and forth on the floor of the double-exit member before slowing and exiting. These double-exit members may be placed to favor an entry direction perpendicular to the exit pathway direction to encourage the longer dwell time of marbles within the receiving double-exit member. Alternately, a very fast course could, for example, include flexible tubes that skip down many layers, and/or many modular member heights, in a single swoop.

Races. Races of all sorts have a start and a finish and rules controlling the start and finish. Running races, auto races, bicycle races, sailboat races, cross-country ski races, and marble run races, for example, have rules and/or layouts and geometries that attempt to provide a fair start that do not give an immediate advantage to any participant merely by the participant's assigned start position, as well as rules for defining the winner and the places achieved by subsequent finishers.

The starting positions for participants in a race typically have a grouped proximity. There may be a preferred position. If the race is long enough, although there may be a preferred position for the start, this advantage can be overwhelmed by the length and other factors of the race. If the starting position is too determinative of the finish, the race is unfair. Therefore, races of all types take measures to provide a fair start.

A 100-meter running race, for example, takes place on a straightaway. There are not curves. The starting line is straight and perpendicular to the direction of travel and parallel to the finish line. Not all starting positions are equally advantageous however. Runners in the innermost and outermost lanes have only one neighboring lane, whereas all others have neighbors to left and right. A 400-meter running race includes two curves of a track and so has a staggered start. Each runner remains in their lane throughout the race. While each participant runs the same distance to the finish line, each runs a different radius curve depending upon lane assignment, measuring the 400 meters back from the straight finish line produces the offsets of the staggered start. A 1600 meter running race may begin with a staggered start, like the 400-meter example above, or sometimes may have a waterfall start, which is a start on a straight line perpendicular to a straightaway of the track, like the 100-meter example above. A runner in a far outer lane of a waterfall start must run a diagonal, and thus a longer distance, during the initial stretch of the 1600-meter race during which the multiple lanes of the start condense into a single preferred inner lane with its shorter turn radius and overall shorter distance over the entirety of the race. The inner lane starting position is therefore at an advantage over the outer lane starting position. In auto races, similarly, the pole position is the favored start for reasons of track geometry like running races. Mass start sailboat races also start on a straight starting line but with forewarning of the timing of the start. During the countdown to the start, the participants vie for optimum position on the starting line which tends to have a favored end.

Races on racetracks are two dimensional races; races that occur on a plane or undulating plane. All the movement in the race is in the x and y coordinates of a horizontal racecourse. Various embodiments of the present invention include a start for a three-dimensional race, a race in the x and y horizontal directions, but also in the vertical z direction. The starting positions may comprise a perimeter, an area, and can be in the shape of a circle or a bowl in three dimensions. The marbles or other participants may depart the starting positions moving downward and inward toward a common choke point. The choke point can be below the start area, optionally centered below the start area, but in other embodiments may be offset from center.

In various configurations optimized for start equality, a circular start area or perimeter with a choke point or zone below the center of the circle may provide an equal radial distance and vertical distance for each marble to descend from its starting position to the choke point or zone. These radial and vertical distances may also be varied while remaining within the scope of the present invention as discussed in the marble choreography section below.

In a two-dimensional race, such as the running races described above, the contestants cross over a starting line from one side to the other on the horizontal plane of the race. In the three-dimensional racecourse with the perimeter/area/circular start according to various embodiments described herein, the participants/marbles may begin a race with a descent through and under the perimeter/area/circle that may define the start.

With a perimeter/area/circular start, fairness may come from factors increasing the similarity of each starting position, as much as possible making each starting position congruent with or equal in shape, form, or length to the others with respect to a travel path toward a common station or choke point or zone along the racecourse. Any concentration of starting positions in any portion of the perimeter/area/circle has the tendency to create differences in the nature of the starting positions with respect to one another. The more the starting positions are distributed along the circle or perimeter the more the positions will be the same with respect to their neighbors. This is discussed in more detail below, including in the section on marble choreography below.

By connecting back on itself, by describing a shape rather than a line, the perimeter/area/circular start may not have end positions or lanes that are distinctly different from middle positions or lanes. Every dedicated starting position may have a clockwise or counterclockwise neighbor, unlike the example of the 100-meter, 400-meter and 1600-meter running races described above. The greatest similarity of each start position may come from having equidistant spacing of the start positions around the perimeter as opposed to clustering in one portion of the circle or perimeter. Some embodiments of the invention, however, may allow or require such clustering without departing from the principles of the invention, as discussed in more detail below regarding marble choreography.

A perimeter/area/circular starting line contrasts with these other races in which contestants start along pathways that are parallel or generally parallel to one another. With a race with a circular starting line some of the contestants/marbles may run/roll toward one another at the start. The race may begin with the contestants/marbles spread out rather than clustered together, with the average separation distance between contestants continually decreasing during the first moments or section of the race. This separation distance can decrease all the way down to a choke point or zone allowing only one contestant/marble through at a time. In a race with a circular (or perimeter) start leading to a choke point, a plurality of contestants initially proceeds toward one another and a sorting into a sequential line may be forced by the choke point or zone. Looser and looser choke points or zones are also possible which allow two contestants or more at a time, even allowing all contestants through the choke point simultaneously should they arrive so uniformly. In embodiments allowing one or more contestants/marbles through the choke point or zone simultaneously, further sorting of the contestants/marbles may occur in subsequent members of or sections of the racecourse.

Some races have a common course that all participants must follow. The contestants/marbles may all consolidate down to a single file line at the choke point or zone and then remain on a single pathway or be divided into two or more separate pathways or branches of the racecourse. Other races allow the contestants/marbles to travel any route between the start and finish. Still other races, in addition to the start and finish, have one or more required intermediate stations between the start and finish that must be reached during the course of the race.

Game Systems, Randomizers and Board Games. Games exist along a continuum from pure luck to pure skill. A game such as "go fish" is on the pure luck end of the spectrum with chess on the other end of the spectrum of pure skill. A game that might otherwise be more on the skill end of the spectrum may have more luck introduced by adding in some type of randomizer such as dice or the drawing of sticks or cards. A randomizer, by adding a degree of luck to the outcome of a game, allows players with different levels of skill to compete. A randomizer allows the less skilled to have a better chance of winning due to the introduction of luck that the randomizer brings to the game.

In various embodiments of the present invention, orbs, spheres or marbles, for example, may be released from a starting perimeter and subsequently line up in a ranked order along a single lane pathway. This mechanism can be used as a randomizer for use with a game such as a board game. The mechanism may be used at any, or all of, the beginning, middle, and end of the board game as desired for the particular board game experience, including introducing luck at any time during the game.

A standard deck of 52 playing cards can be thought of as a game system, meaning that the cards can be used to play a number of different games and new games may continue to be devised using the 52 cards. As such, bridge, gin, go fish, five card stud and solitaire, just to name a few card games, have been developed over the years. Dice similarly constitute a game system and are used for randomization in many games and are also used as the principal component of games such as craps, Yahtzee and Farkle. In these two examples of game systems, there is nothing about the cards or the die that gives any player an advantage from the outset. Cards are shuffled and dice are shaken as a means of mixing the components to remove any suspicion or chance that one player may somehow have an advantage over others or have a trick for gaining advantage.

A randomizer comprising a perimeter/area/circular starting line may work as a portion of a marble-based game system, for example, as a means of scrambling the marbles in a way analogous to the shuffling of cards or the shaking of dice. Any number of games using such randomization of marbles may be developed over time that use the present invention. As in a card game in which any player may get a set number of the whole pack of 52 cards at the outset, a marble game may also provide a set number of marbles randomly assigned to each player.

Figure 16:
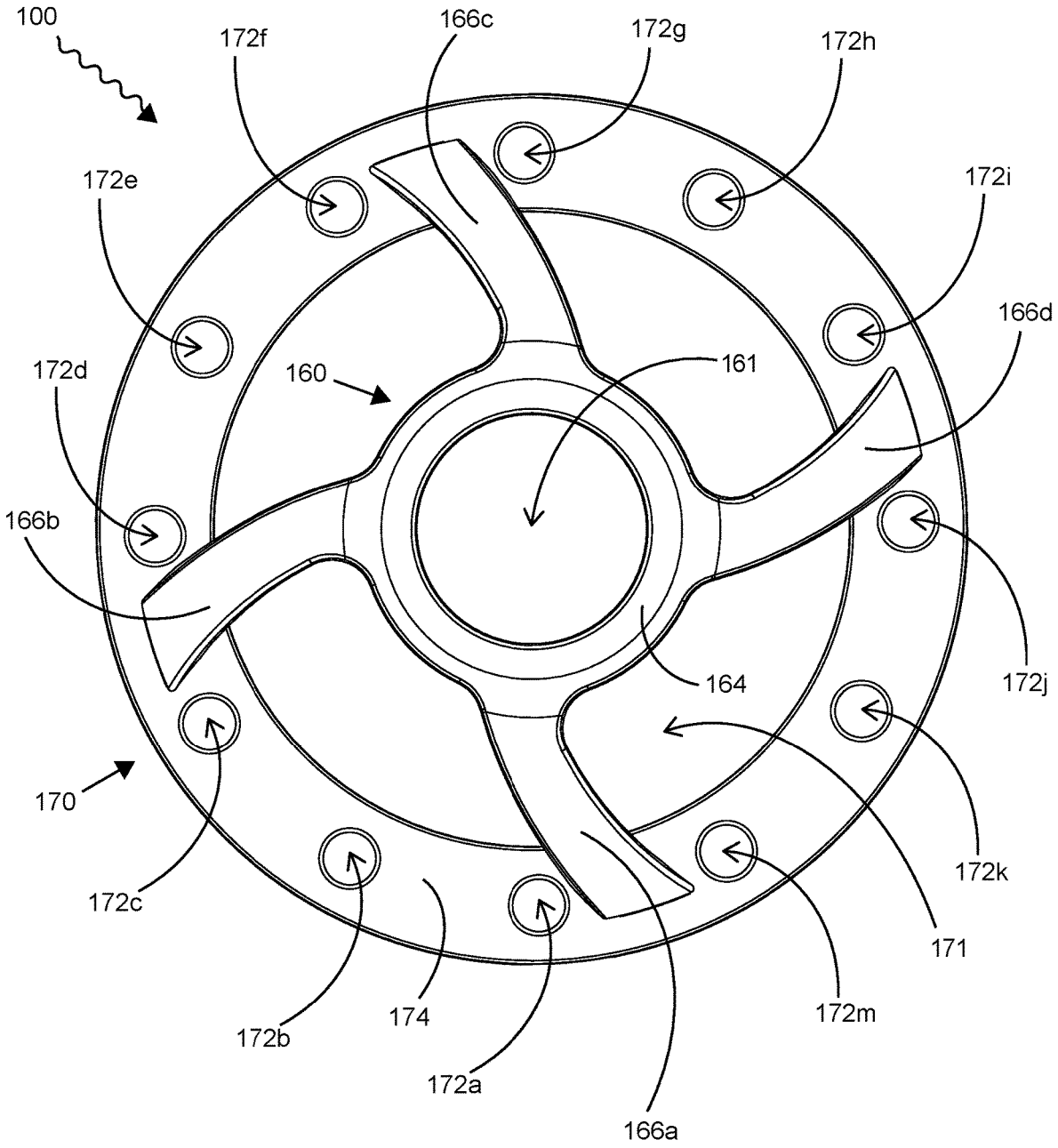
FIG. 16 illustrates a plan view of the first component, in accordance with one embodiment.

As shown, in some embodiments, the starter accessory 400 FIG. 25 may have a handle 160 FIG. 16 with, for example, four legs 166*a*, 166*b*, 166*c* and 166*d*. Between each pair of legs may be three openings for marbles, for example between legs 166*a* and 166*b* are the three openings 172*a*, 172*b*, and 172*c*. Players such as four players sitting around a game table with the starter accessory in the middle could have the accessory placed to present a section such as a quadrant of the starter accessory to each of the players, with each of the players having ready access for loading marbles into their own section such as the quadrant between the nearest respective legs of the handle 160. Such an arrangement provides perimeter uniformity of the starter assembly to present an equal face to any player around a table, so each player has a congruent experience compared to the other players with respect to how they interact with the marbles and the starter assembly. Each player is able to load marbles and watch marbles flow after launch in a fair and equal way to that of the other players. The marbles, too, when flowing into the structure may flow over matching surfaces so no player is advantaged or disadvantaged with respect to another player based on which section they have been assigned for the game. It will be understood that any suitable number of "legs" or openings may be used in different embodiments of the present disclosure.

The finish line may be a single line of marbles in ranked sequential order based upon time of arrival, in some embodiments. There can also be multiple finish lines or destinations. A collector portion or finish tray of a game could, for example, have a number of destinations each of which may hold one marble. The destinations could be arrayed around a center in order to present one marble destination to each of the players that may be seated around a table, for example. In other embodiments, the destinations could have other geometries relative to one another.

In some embodiments of the present disclosure, spheres or marbles may be released from a starting perimeter and rather than proceeding to one single lane pathway, the marbles may be diverted to various distinct pathways. For example, the marbles starting at the perimeter could travel to four separate single lane pathways called pathway A, pathway B, pathway C and pathway D. Various numbers of marbles may randomly arrive at any of these various pathways and be sorted in ranked order in one of the four (or in other embodiments more or fewer than four) single lane pathways. An embodiment with four destination positions could work with marbles in four colors, for example. How the marbles of different colors, or designs, or other markings arrive at their destinations may have a bearing on the related games developed for this embodiment. The four marbles could come out into four different positions. The combination of color and position could then be used to help drive some aspect of the play of the game after each or any running of this or other embodiments of the randomizer.

In some embodiments of the present invention, there may be only one winning position and all other marbles remain in a non-ranked grouping. Alternatively, there could be several winning positions with extra marbles remaining in a non-ranked grouping.

Other embodiments may constitute a short marble race and may have more or fewer marbles. One example has just two marbles. Such embodiments may be used for making binary, yes/no, on/off decisions in a game or otherwise. Place the marbles and release them from their resting platforms. They randomly scramble and the results can be read once the motion stops.

Timers. A randomizer may also take a long time to deliver the randomization and the invention may be used in such games that may benefit from the delay in the delivery of the randomization result. Larger assemblies with various launcher embodiments and/or with various finish line base embodiments could act as timers in the course of game play. Players of a game could conduct parallel activities during the time marbles are rolling through an assembly such as the marble race configuration 600. Strategy can involve the design of new assemblies or configurations of parts, thereby designing the timer device itself. Strategy can also involve how marbles are loaded into the device. A player may have a time limit to complete some task within the amount of time it takes for one or more marbles to reach the base, or until a certain number of a certain color of marbles collects in a certain tray assigned to this player.

Gambling Devices. A roulette wheel uses a marble arriving in any of various terminal positions as a device upon which people wager bets. The present invention in some embodiments may work as a gambling device. The various ways the present invention may work as a game may also be translated into games upon which people wager bets. This can involve the single terminus or the multiple terminus pathway systems as described herein. It can also involve the use of marbles that are colored, coded, or otherwise differentiated, so that unlike roulette, which uses a single marble, gambling games with the present invention may comprise multiple marbles which may all be the same or which can be differentiated from one another. Betting with respect to the present invention could involve betting on the terminal location of a marble as in roulette, but with the use of multiple marbles, the betting could have further complexity accounting for not just the terminal location of the single marble, but also the color of the plurality of marbles and their terminal locations and/or their terminal ranked order.

Education: STEM and STEAM. STEM (short for science, technology, engineering and math) education and STEM skills are key to success in most technical and engineering fields. Such fields offer careers which can be both intellectually and financially rewarding. STEAM takes this one step further introducing art as another key skill which is valuable for its focus on aesthetics, creativity and non-linear thinking. Parents are very interested in the providing opportunities for their children to have both STEM and STEAM educational experiences.

Spatial reasoning is that third portion of an IQ test, these tests which measure verbal, math and spatial reasoning skills. Spatial reasoning, both how it happens in a brain/body and how to best teach it, is not as well understood nor is it systematically taught in schools as language and math skills are. Spatial reasoning often focuses on two dimensions, thinking of space in terms of maps and how we move around on the flat surface of the earth in ways that can be described by maps and GIS tools. The Z dimension, the vertical component of the X, Y, Z Cartesian coordinates is left out. Following plans to build three dimensional structures is a way to develop, practice and exercise spatial reasoning ability. Devising and building new plans of one's own is a further and higher-level method to develop these skills. When the plans lead to the creation of marble racecourses what is being built is not just an object composed of multiple parts, it is also a pathway system. It is a conglomerated object, but it is also a pathway system. Activating that pathway system with flowing marbles is a way to learn about the nature of the pathway system and the nature of the marbles flowing through it. The player engages in the scientific method, in experimentation, trial and error, probing, testing, exploring, and discovering. This exploration may include building an assembly of parts and testing the assembly with a flow of marbles and then, optionally, reflecting upon these results and devising improvements to the assembly, adjusting, and rebuilding the assembly, and running the test again with another flow or multiple flows of marbles and so on.

Various embodiments of the present disclosure in the marble race configuration 600 may have a central vertical axis that extends up from the center of the joinery on top of the collector base 300 up through the structure and the center of the starter accessory 400. As can be seen in the elevation view FIG. 14, this is a symmetrical configuration. Rotational force applied to the handle 160 rotates around the central vertical axis and is transmitted down to the collector base 300 and the floor beneath it. With the kind of raucous play such a game or toy may endure with either solo or group play, this axial symmetry combined with the sturdy base and using the sturdy joinery or the modular cubes and accessories may be provide structural support for the assembly. Symmetry can also provide stability. Symmetry is also an aesthetic choice in the design of a configuration or assembly, and the modular pathway apparatus, its accessories and the present invention may all work together to allow experimentation with configurations featuring not only symmetry, but also asymmetry, and/or balanced asymmetry.

The form of an assembly provides a visual impression that can be described as symmetrical or asymmetrical. Because the members and parts of a configuration allow for the passage of marbles over or through one another, a pathway network, sometimes quite intricate, may be contained within the overall form. A configuration, therefore, is not just a form, but a pathway system that has certain characteristics with respect to how marbles may flow through this pathway system. Various embodiments of the starter assembly 400 of the present disclosure may be inserted at various positions on top of a configuration and thus it may act as a testing device for sending like flows of marbles into varying positions on a configuration. The starter assembly may work as a probe, as a testing device that assists the user in evaluating how the pathway network of a configuration performs. The user may employ an experimental scientific mindset to this exploration and what might otherwise be thought of as a game or toy reveals its utility as a science learning tool for both STEM and STEAM educational lessons.

Using the components and accessories to the modular pathway apparatus, a person playing with these components may produce innumerable variations of marble racecourses which may run from the minimal, such as including only the start accessory and the collector base (a randomizer), to the extensive, including many different components and including multiple variously converging and diverging pathways. Races may have a single proscribed course or one or more potential pathways through from start to finish.

It is possible to start a race by merely picking up a handful of marbles and dropping them into an upper or elevated member of a configuration. The starter assembly allows a more controlled start and a mechanical assurance that the various contestants (marbles) are given an equal chance from the outset of the race.

There may be multiple possible connection points for the starter assembly. The starter assembly can be attached to any configuration of the modular pathway apparatus, optionally including some adjustment for balance or strength in certain circumstances. The nature of the flow of marbles can be probed round about on various desired start locations to see how the marbles from the starter assembly react and flow from these different staring points. These various connection points may align with the grid of modular units below in some embodiments, the modular units may define a shifted Cartesian spatial pattern in which neighboring modular members may be shifted vertically one half a neighbor member height with respect to one another.

Collaborative Play. The nature of embodiments of the present disclosure that allows it to provide a fair start to races of marbles or other participants makes it conducive to collaborative play. Various aspects of the play experience may be approached in a collaborative manner by a plurality of players. The design and building of a configuration may proceed collaboratively. Players may also collaboratively develop rules for different games and races to play using the present invention as part of a configuration. Players may each run their own "teams" of colored marbles through one or more heats of races through a configuration. Alternatively, players may work together to load various colored marbles into a starter assembly 300 and take more of a dispassionate viewpoint toward the "teams" of colored marbles, not personally associating with a team and instead just observing, together with the other collaborative players, the resulting scores from placing of the various "teams" of colored marbles.

Starter Accessory. FIGS. 25 to 27 show an embodiment of a starter element 400 comprising a first component 100 and a second component 200. In some embodiments, the first component may rest upon the second component in a position such that a marble placed in an opening 172 in the first component 100 can be held in place over a starting platform 201 of the second component 200 as shown in FIG. 26. A short counterclockwise rotation about a central vertical axis of the first component 100 is sufficient to displace the marble off of the starting platform 201 and over the sloping surface 220 allowing gravity to drop the marble onto the sloping surface toward the exit opening 251. A plurality of openings 172 with starting platforms 201 below may be arrayed around the central vertical axis of the first component. These openings and starting platforms may differ only in their rotational position with respect to the vertical axis thus making each pathway from starting position to exit opening identical in all other respects.

Figure 15:
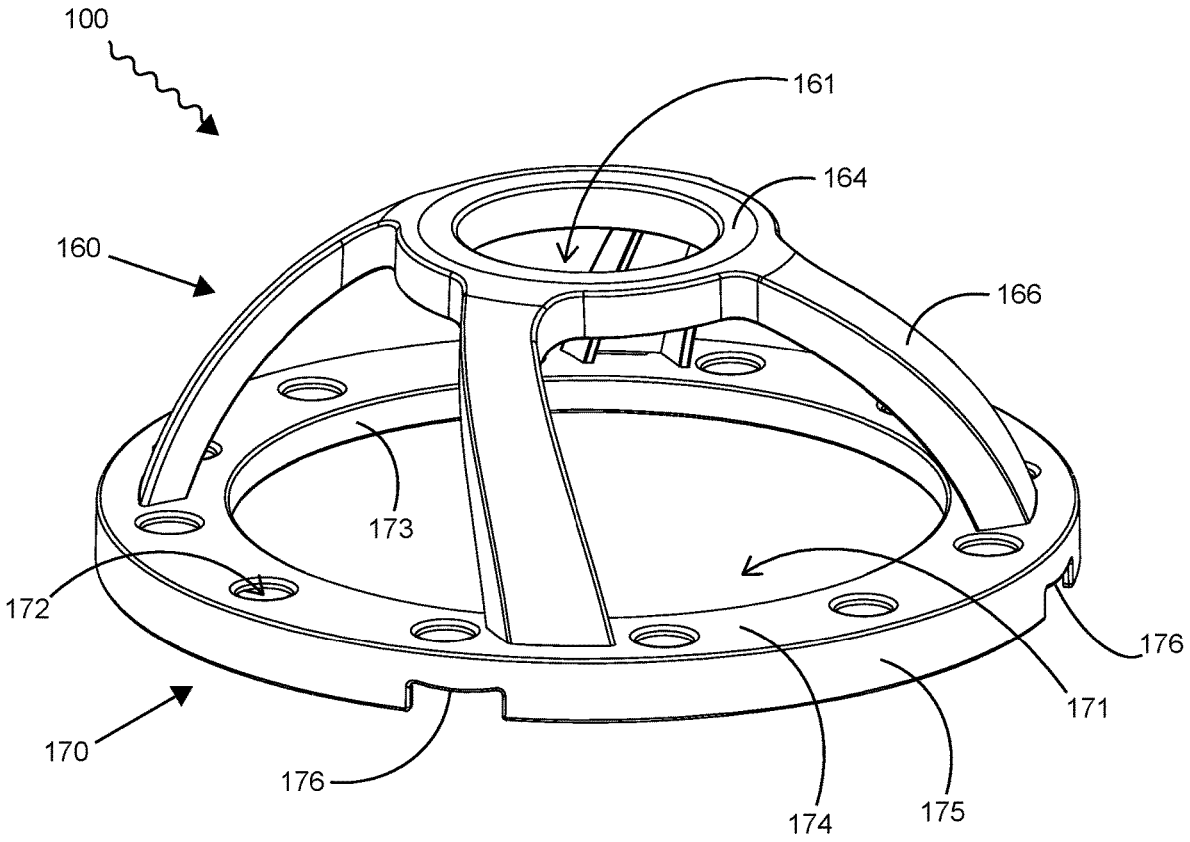
FIG. 15 illustrates a perspective view of the first component, in accordance with one embodiment.
Figure 20:
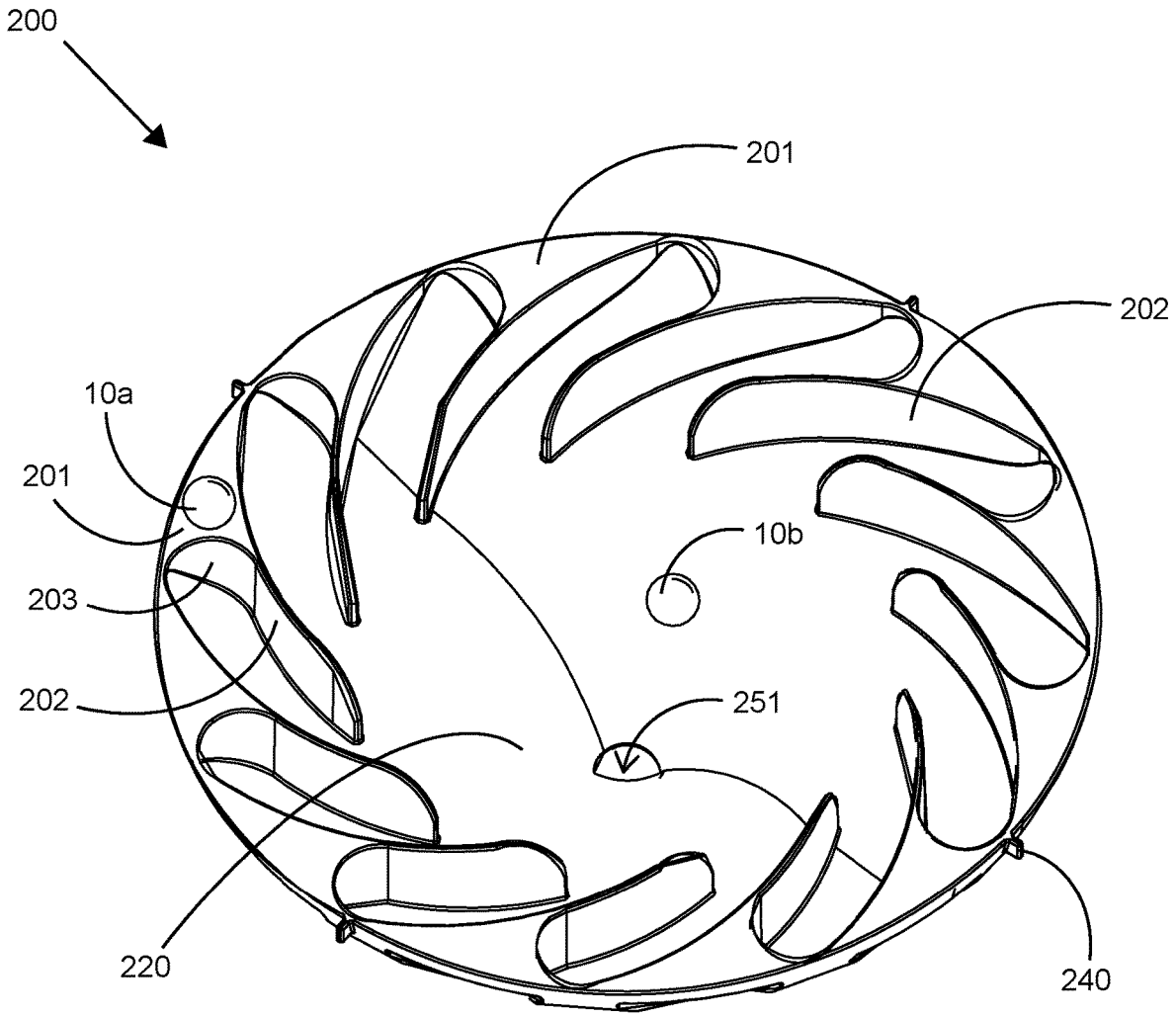
FIG. 20 illustrates a perspective view of the second component, in accordance with one embodiment.
Figure 21:
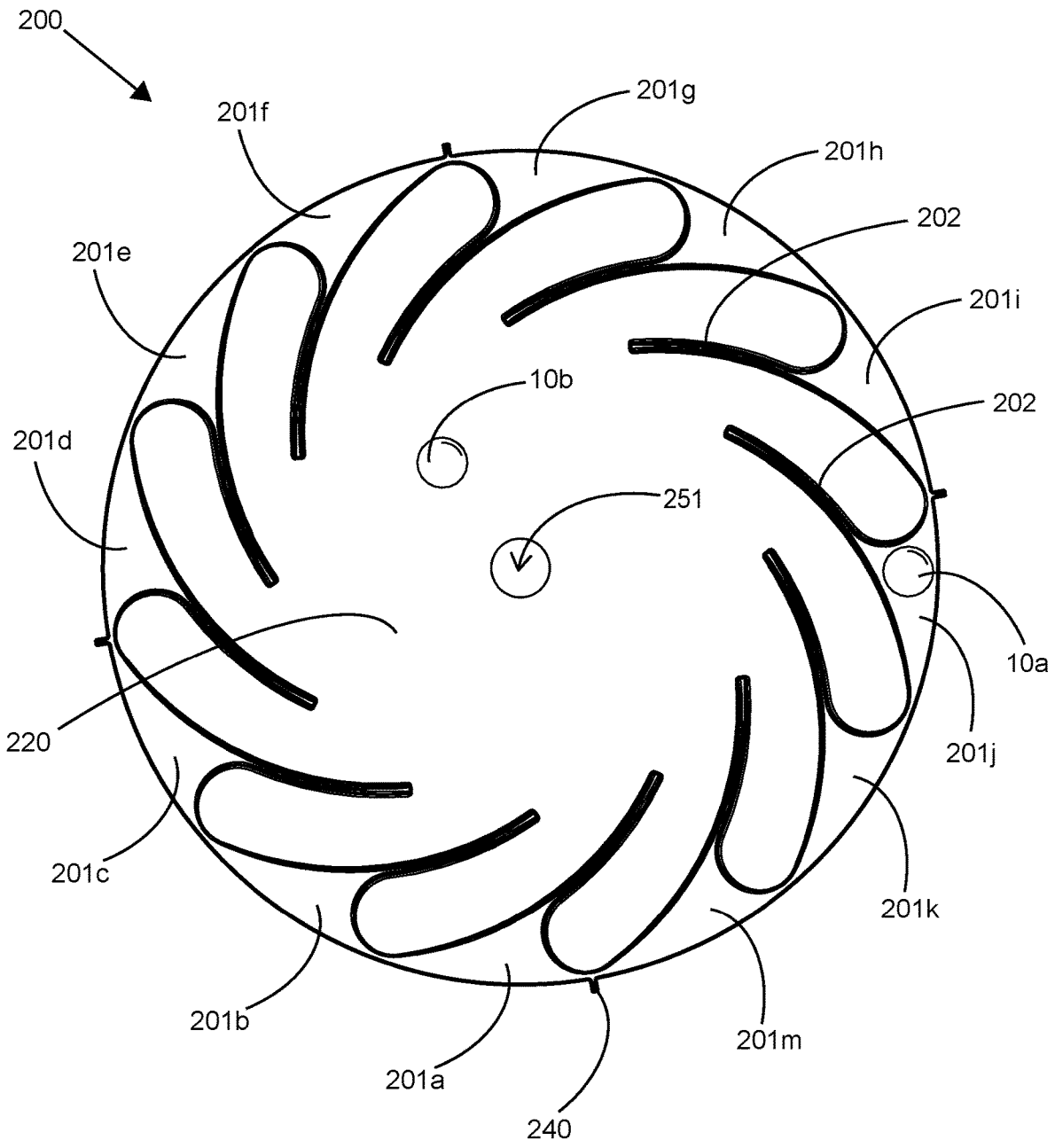
FIG. 21 illustrates a plan view of the second component, in accordance with one embodiment.
Figure 24:
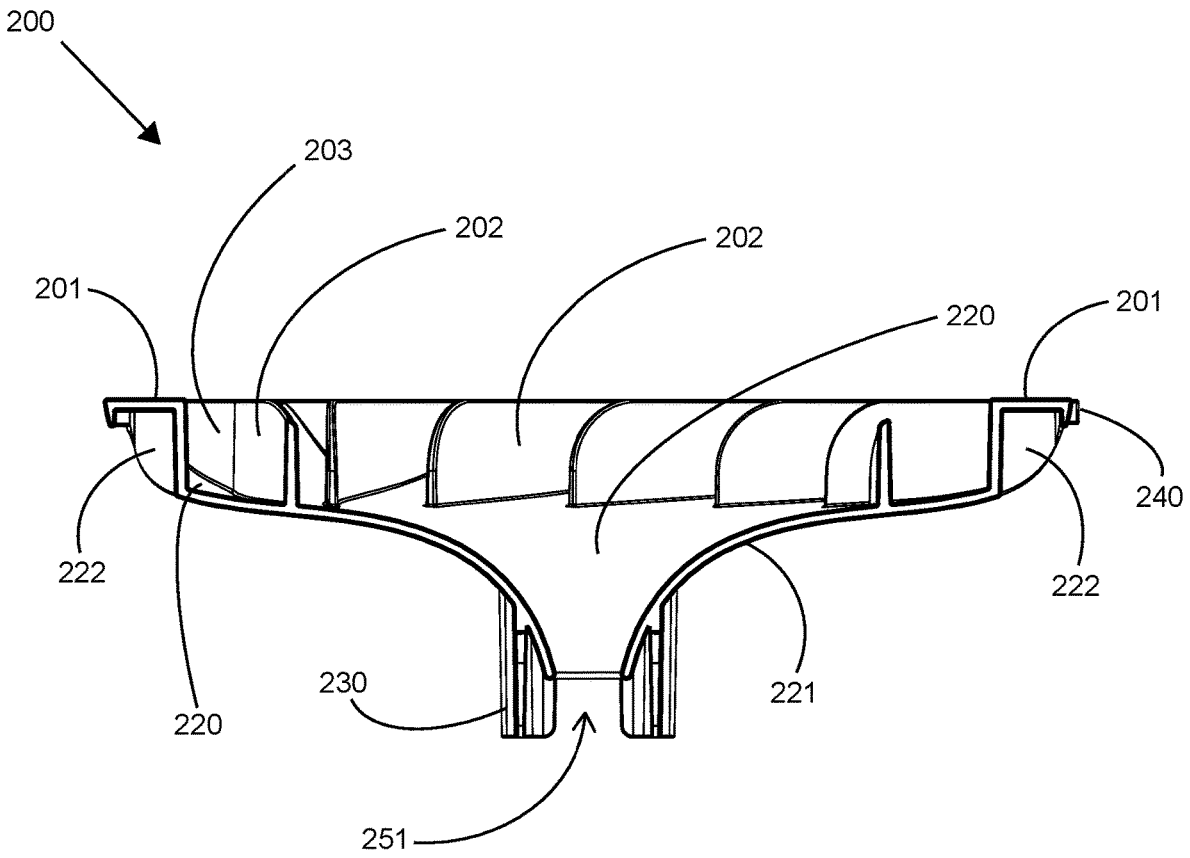
FIG. 24 illustrates a cross-section view of the second component, in accordance with one embodiment.

The top view of the starter element 400 of FIG. 26 shows the exit opening 251 centered under both the circular opening 161 and the circular opening 171. FIGS. 20, 21 and 24 show the exit opening 251 in the center of the sloping surface 220 of the second component 200. FIG. 15 shows the circular opening 171 in the lower ring 170 of the first component 100. FIG. 15 also shows the circular opening 161 of the upper ring 164 of the handle 160 of the first component 100. A player operating the starter element 400 may gain a clear view down the vertical central axis through the circular openings 161 and 171 for watching the marbles rotate and jostle around and down through the exit opening 251. When formed with transparent plastic this view continues down through the transparent material to further portions of the marble pathways below. In the case of the randomizer 500, this axial top view allows a player from this centered vantage point to see the marbles exit the starter 400 and arrive on the collector in their final ranked order.

As seen in the embodiment shown in FIG. 25, the four legs 166 may lift the upper ring 164 up above the top of the second component 200 thus allowing oblique views into the interior, such as the view shown in FIG. 25, allowing a player to better see the curved walls 202 between which the marbles flow and to better see the sloping surface 220 upon which the marbles flow.

Figure 19:
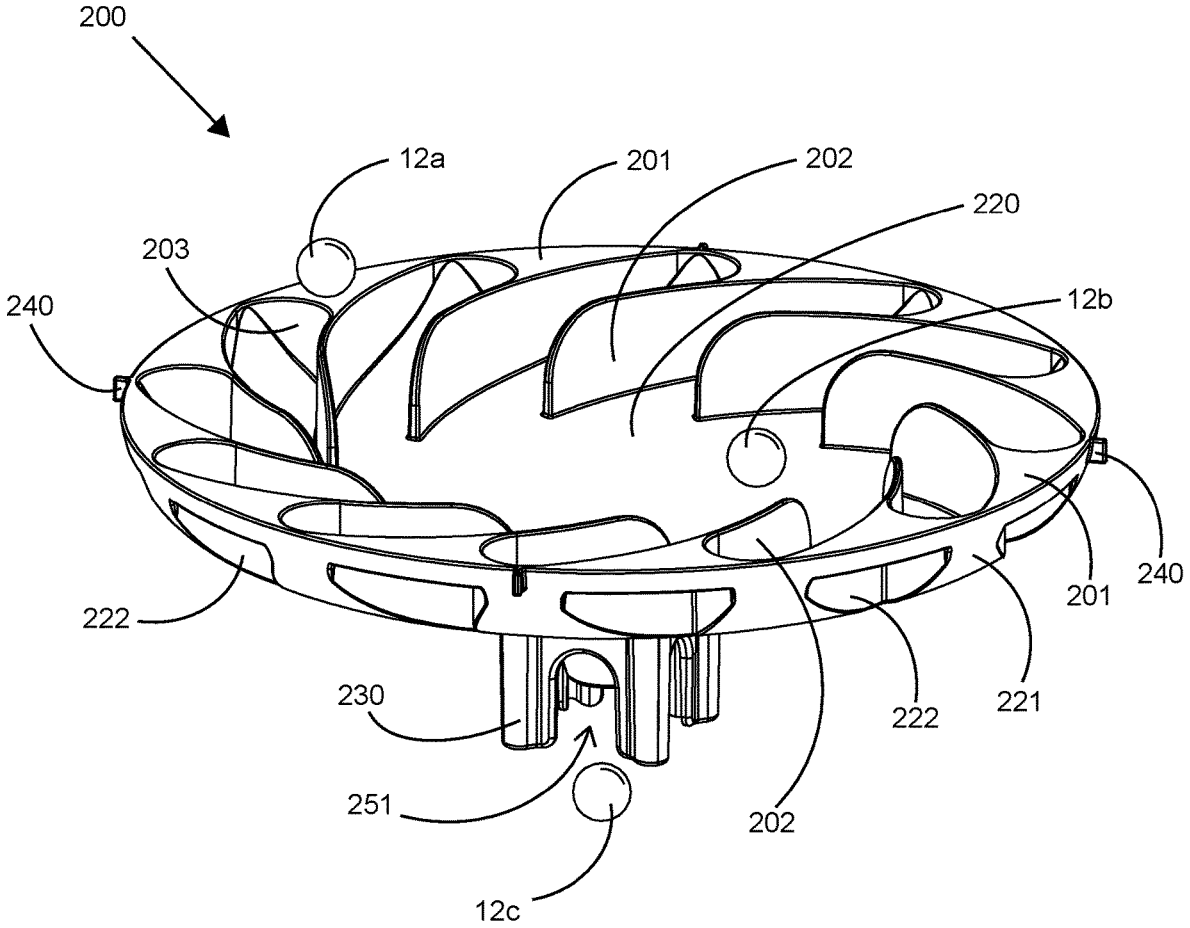
FIG. 19 illustrates a perspective view of the second component, in accordance with one embodiment.

The top view in FIG. 26 of the starter accessory shows a first marble 10*a* and a second marble 11*a* in two of the twelve openings 172 in the first component 100 and the same two marbles as 10*b* and 11*b* in descent toward the exit opening 251 on the sloped surface 220. FIG. 19, similarly, shows a marble travelling on and out of the second component or bowl 200, first the marble 12*a* is shown at rest on a platform 201, then the marble 12*b* is shown in descent on the sloped surface 220 and finally the marble 12*c* is shown having exited out the bottom of the second component through the exit opening 251.

Figure 2:
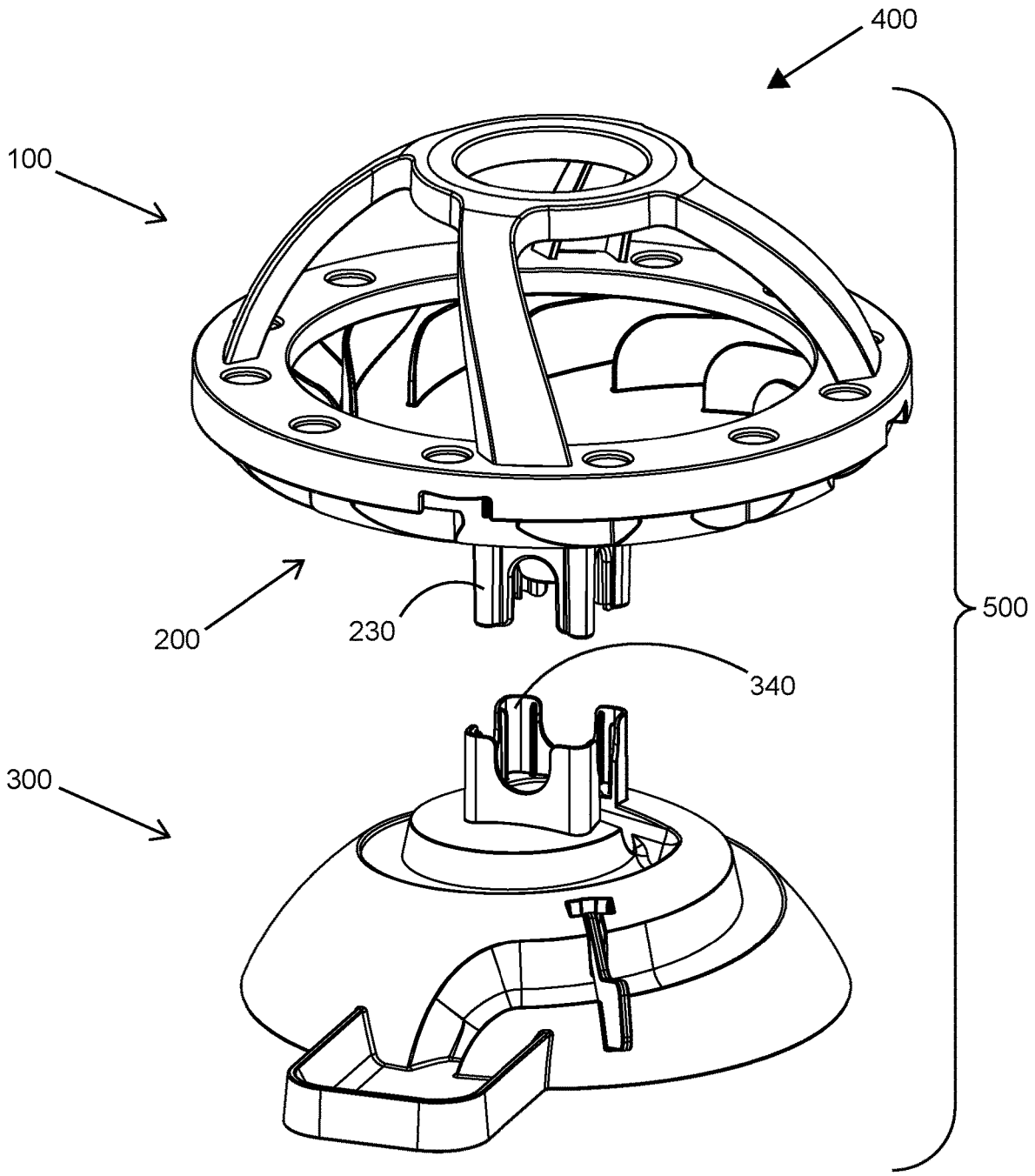
FIG. 2 illustrates a perspective view of the starter assembly and the collector vertically aligned in an exploded arrangement, in accordance with one embodiment.
Figure 12:
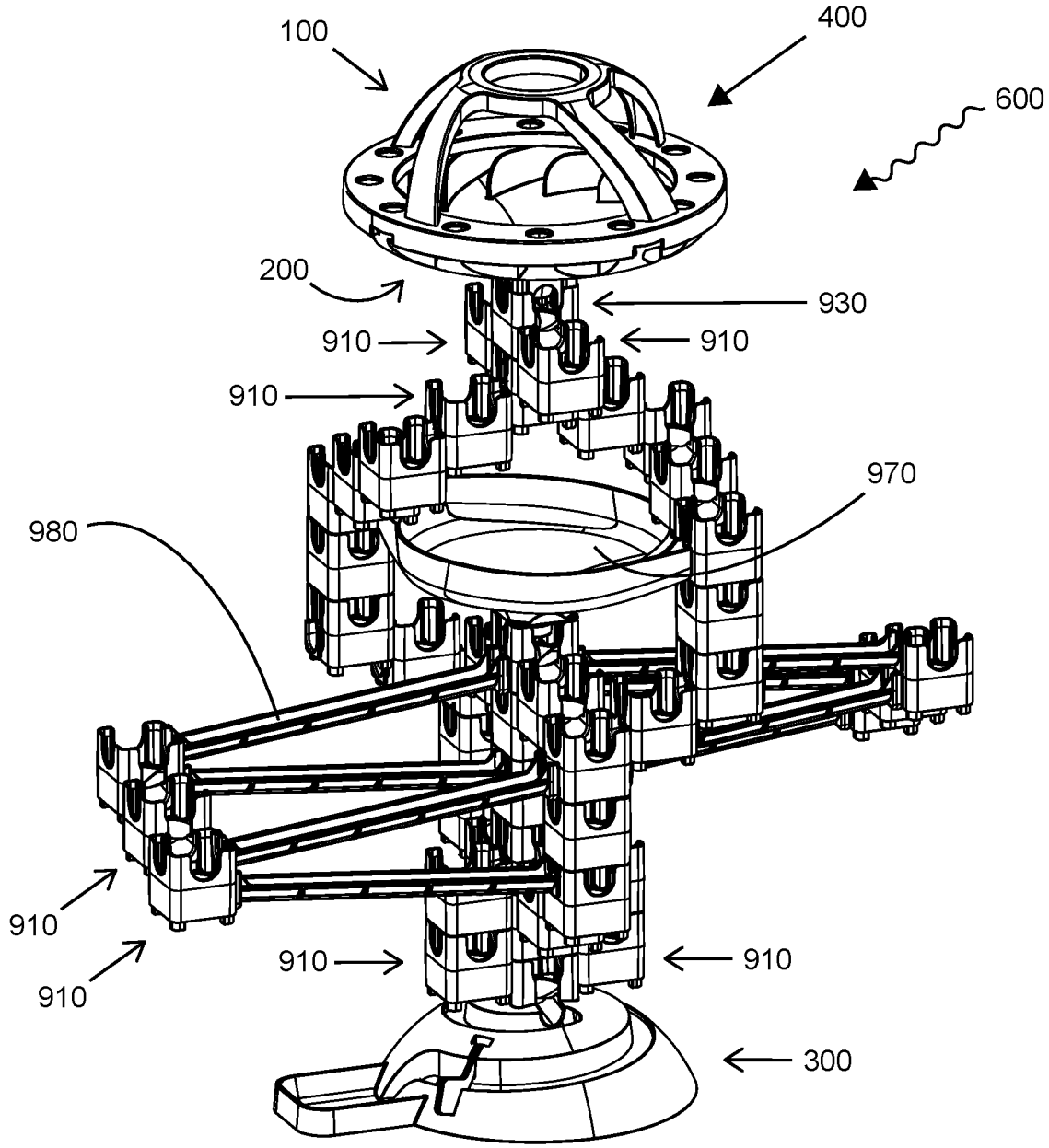
FIG. 12 illustrates a perspective view of a configuration of the starter assembly and the collector together with cubes and accessories of the modular pathway apparatus, in accordance with one embodiment.
Figure 14:
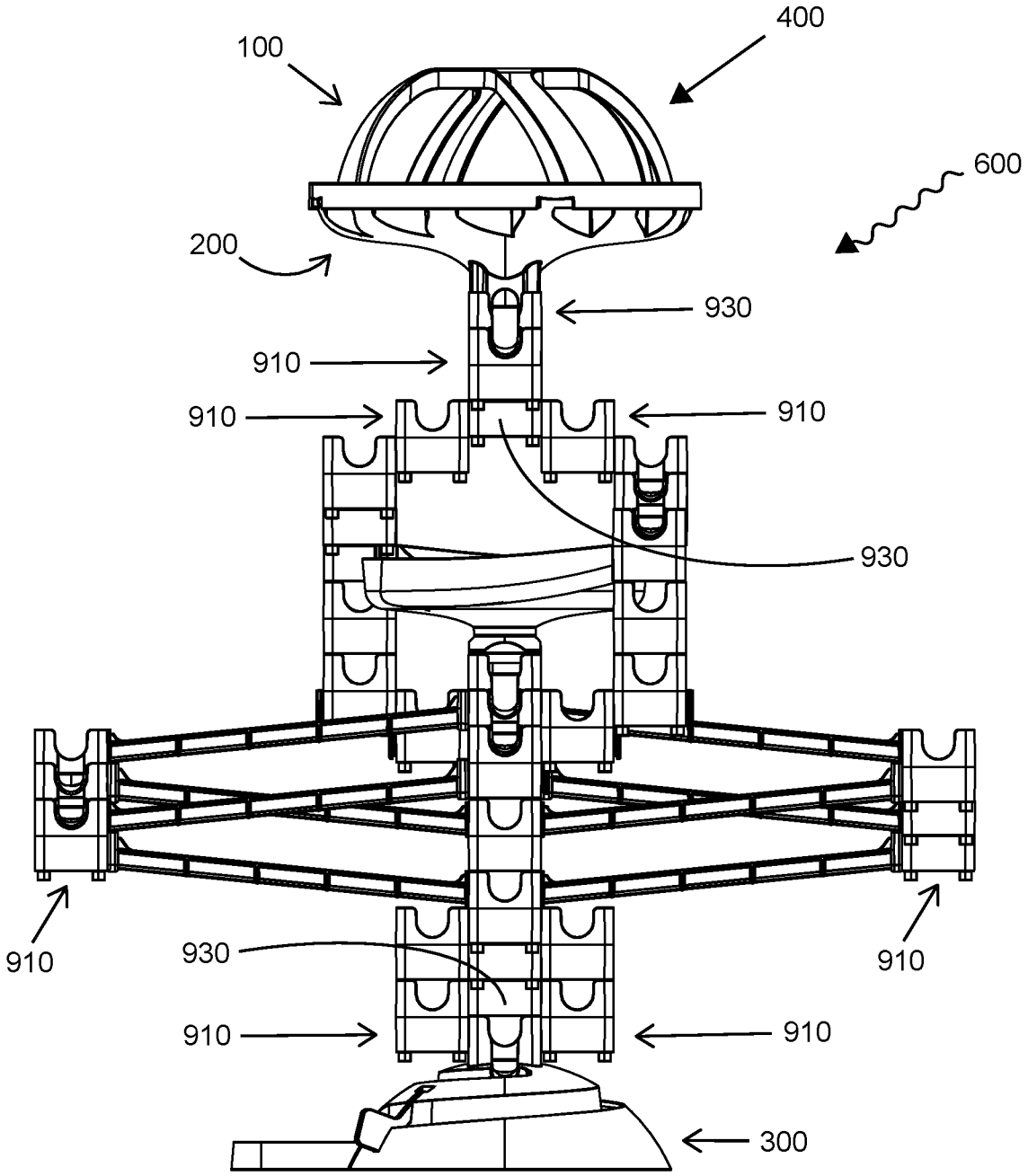
FIG. 14 illustrates an elevation view of the same configuration as in FIG. 12 of the starter assembly and the collector together with cubes and accessories of the modular pathway apparatus, in accordance with one embodiment.
Figure 23:
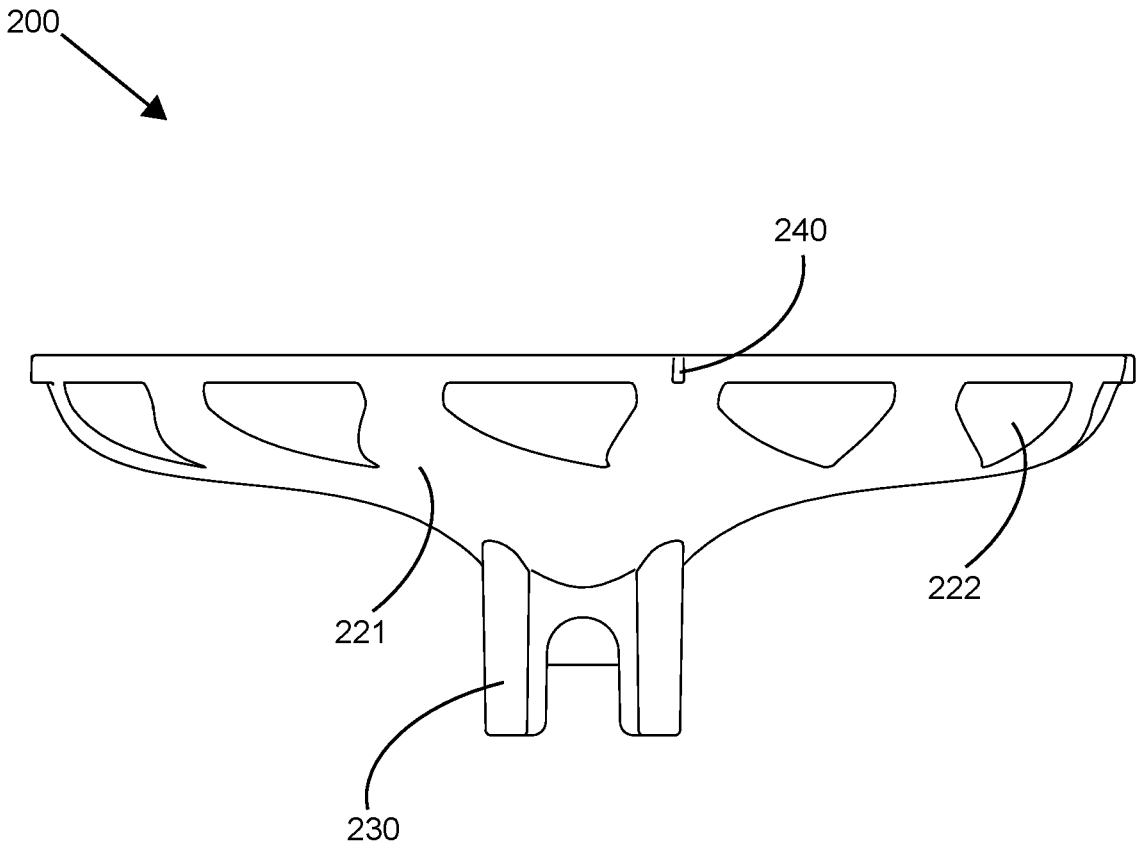
FIG. 23 illustrates an elevation view of the second component, in accordance with one embodiment.

A four-legged male joinery 230 can be seen on the bottom of the starter accessory 400 in FIGS. 25 and 27. FIG. 2 shows this male joinery 230 in position to press down into the female opening 342 of the collector base 300, while FIG. 3 shows the male joinery 230 fully nested into position in the collector base 300. Similarly, FIG. 8 shows this male joinery 230 in position to press down into the female opening 941 of a modular cube 910 and FIGS. 12 and 14 show the male joinery 230 on the bottom of a starter accessory 400 fully engaged in a modular cube 930. FIG. 23 shows the second component from below revealing the generally square form of the four-legged male joinery 230. This square joinery resists rotational forces applied to the starter accessory during repeated operation for marble release thereby keeping the starter accessory in position with respect to components in a configuration such as the non-limiting example configuration 600 or the randomizer 500. In other embodiments, there may be fewer or more legs and/or other structural components to provide strength and joinery.

With reference to FIGS. 25 and 27, a notch in the bottom of the side wall 175 of first component 100 nests around a small protrusion 240 from the side of the second component 200. The notch may be configured in some embodiments to allow a limited clock-wise and counter-clockwise rotation of the first component 100 sufficient to hold a marble in place within an opening configured to hold a marble 172 on top of a starting platform 201 and to rotate it off of the starting platform and into position beyond the curved portion of the wall surface 203 of FIG. 20 to begin a descent down along the sloping surface 220. In other embodiments alternate ways of connecting the first and second component may be used.

In another embodiment, first component 100 comprises only the ring 170 and there is no handle 160. In this variation, the view for watching the marble action is fully opened up and the means of launching the marbles is no longer a rotation of the handle but a rotation of the ring directly. Other means of launching the marbles are possible as well, for example, having gates at each starting position that retract or move in order to release the marbles.

In some embodiments of the present disclosure the marbles may begin in starting positions 201 on the bowl or the second component 200 and fall onto the sloping surface 220 as they begin their descent through the second component and toward the exit 251. The distance the marbles fall from the starting position 201 to the sloping surface 220 provides an initial momentum from the gravitational acceleration. In other embodiments the distance the marbles fall at the start of a race could be greater in order to provide greater initial momentum. The handle 160 could be higher above the sloping surface 220 so there would be greater gravitational acceleration in some embodiments. Such an embodiment could also be configured with a circular track in an upper portion of the sloping surface where the speeding marbles could circle round and round possibly multiple times, like how a marble spins around the top of a roulette wheel prior to dropping down to the numbered slots below. The marbles speeding around in such a circular track, upon losing velocity, could then spill out of the track and continue a descent down the sloping surface 220.

In some embodiments, the starter accessory may be reconfigurable. For example, it may be moved from one position to another on a configuration of modular parts, to various locations above cubes, members and accessories following the shifted cartesian spatial grid below. A configuration of parts may form a representative sculpture such as of a dinosaur, robot or flower, and the starter accessory may be attached in various positions on these, such as, for example, the dinosaur's head or tail, to explore how the marble flow differs with the varied positions for the start accessory.

First Component. FIGS. 15 to 18 show one embodiment of the first component 100. This embodiment of the first component comprises a handle portion 160 and a lower ring 170. The lower ring 170 bounds a circular opening 171. The lower ring 170 has a top surface 174, an inner wall 173 and an outer wall 175. The handle portion has an upper ring 164 which is held above the lower ring 170 by four legs 166. The upper ring 164 bounds a circular opening 161. There are four notches 176 in the outer wall 175. In other embodiments there may be any other number of notches.

This embodiment of first component 100 has twelve circular openings 172 each suitable for the passage of a marble and equally spaced around the lower ring 170, though it could alternatively have less or more circular openings. FIG. 16 shows four legs 166*a* to 166*d*. Between leg 166*a* and leg 166*b* is a first set of three openings 172*a*, 172*b* and 172*c*. Between leg 166*c* and leg 166*d* is a second set of three openings 172*g*, 172*h*, and 172*i*. The second set of three openings is point symmetrically arranged about the center of the lower ring 170, so for example, openings 172*a* and 172*g* are point symmetrically located on opposite sides of lower ring 170.

Figure 17:
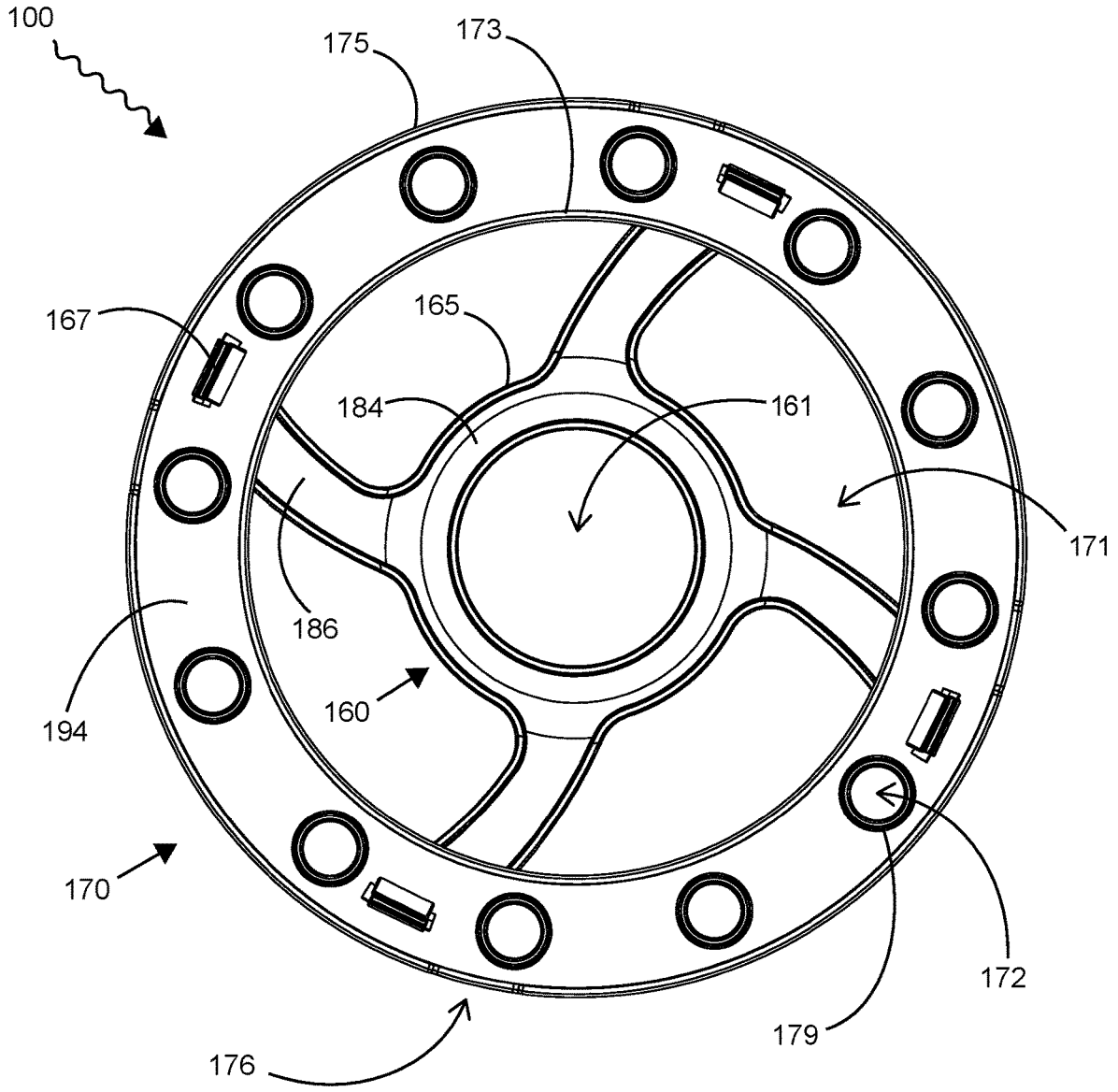
FIG. 17 illustrates a bottom view of the first component, in accordance with one embodiment.
Figure 18:
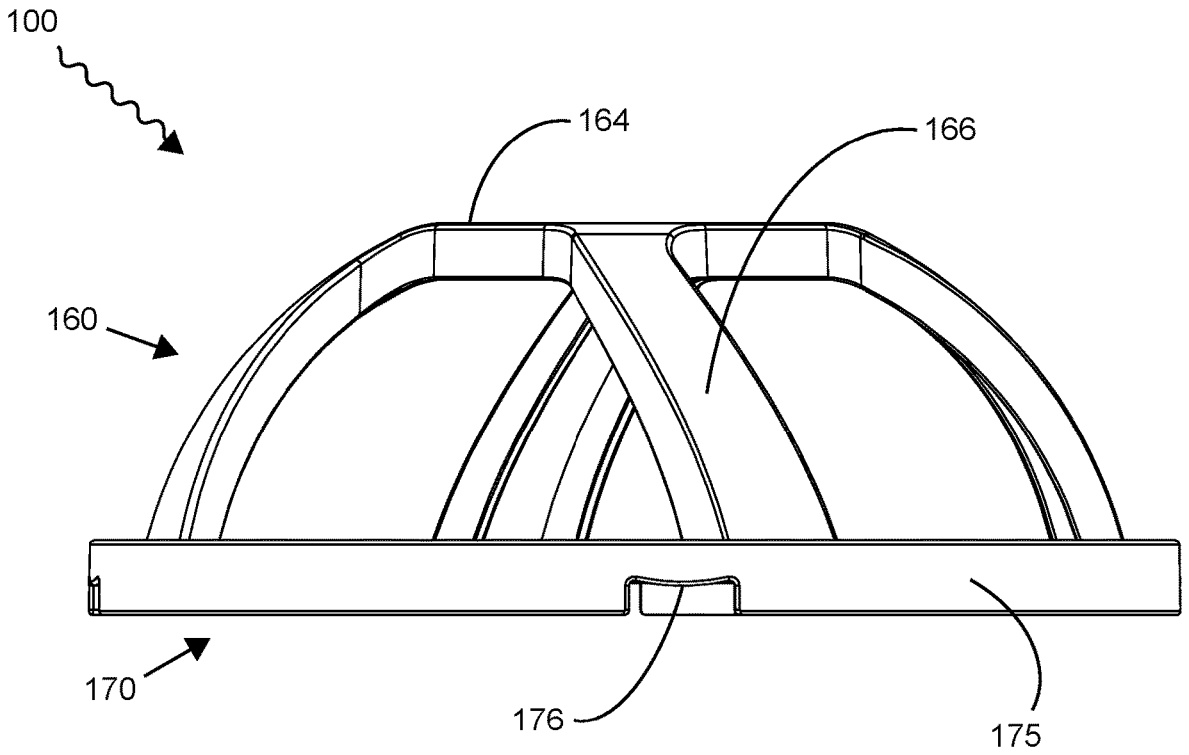
FIG. 18 illustrates an elevation view of the first component, in accordance with one embodiment.

In FIG. 17, four roughly rectangular elements can be seen at quarter points around the lower ring 170. These are the snap connections between the legs 166 of the handle 160 and the lower ring 170. The legs 166 and upper ring 164 or the handle 160 are molded as one piece. The lower ring 170 is also molded as one piece. These two portions 160 and 170 are snap fit together to form the first component 100. In cross-section each of the legs 166 of the first component 100 is a C-channel. The underside of the C-channels can be seen the bottom view FIG. 17 with the thickness of the side walls 165 of the C-channels revealed. This C-channel construction gives the handle 160 structural integrity and gives the starter accessory 400 sturdiness and durability for extended use.

The upper ring 164 may be sized to balance the competing factors of view and ergonomics. The upper ring 164 may be wide enough to allow sufficient view of the racing marbles, but also may be small enough to be a comfortable size for the hand when twisting the handle 160. The legs 166 of the first component may perform a double function: they hold the upper ring 164 up above the lower ring 170 while they also engage the fingers of user who is rotating the handle 160.

While the above embodiment has been described with reference to specific shapes, specific numbers of particular shaped objects and particular relationships between specific shapes, it will be readily understood that it is within the spirit and scope of the present disclosure that other embodiments may use other shapes, numbers of shapes or relationships between shapes.

Second Component. FIGS. 19 to 24 show one embodiment of the second component or bowl 200. In this embodiment, the second component has a downward sloping funnel-like surface 220 with a perimeter and along this perimeter are starting positions for marbles formed as horizontal platforms 201. This embodiment shows twelve starting positions 201, symmetrically and radially arrayed every 30 degrees around and equidistant from a central exit opening 251. This exit opening 251, circular and configured for the passage of one marble at a time, establishes a sequential order early in the race for a plurality of marbles rolling downward through the starter accessory 200. The starting positions 201 are at an equal height above the bottom of the exit opening 251. This embodiment shows each starting position 201 as a flat horizontal surface formed by roughly triangular shaped recesses 222 as seen from below in FIG. 22. A curved wall or fin 202 is associated with each starting platform 201. A tighter curved wall 203 is contiguous with the fin 202. The wall 203 forms a leading edge of the platform 201. Marbles departing the platform roll past the wall 203 and fall down to the sloping surface 220. The fins 220 encourage a counterclockwise spiral motion of each of the marbles as they begin their descent down the sloped surface 220.

In some embodiments the shape, design, and number of starting points may vary. The starting points can have varied heights with respect to one another. The starting points can have varied horizontal distances to the exit 251 with respect to one another. A start can be arranged to release the marbles sequentially rather than simultaneously. A staggered release of a first group or marbles followed by a second group of marbles is possible. Two tiers of marbles may be released from different heights and attain different speeds. Marbles of the same or different weight, mass, density, size, or material may be used.

FIG. 19 shows a marble 12*a* at rest on a starting platform 201, the same marble 12*b* travelling down the sloped surface 220, and the same marble 12*c* having passed down and out the bottom of the exit opening 251. FIG. 24 shows a cross-section through the second component 200 with this embodiment having a vortex form which enhances spiral motion of marbles along the surface 220 and out through the exit opening 251. With the vortex form, the slope of the surface 220 gets progressively steeper toward the center of the second component 200. Marbles rolling along this surface accelerate along this changing slope. The form encourages spiral motion. The slope of the surface 220 can follow an S-curve in cross section as seen in FIG. 24 and in perspective in FIG. 20 in which it is concave up and sloping steeply downward close to the starting position and platform 201 in order to provide an initial burst of speed. The slope transitions into a concave down curvature as the surface nears the exit opening 251, with a transition section of moderate slope between the concave up and concave down portions. The initial steepness of the slope of the surface 220 can be seen in FIG. 24 where the curved wall 203 meets the sloping surface 220, and also in FIG. 20 where the curved wall 203 gets progressively shorter as it approaches the outer edge of the lower component 200.

Figure 28:
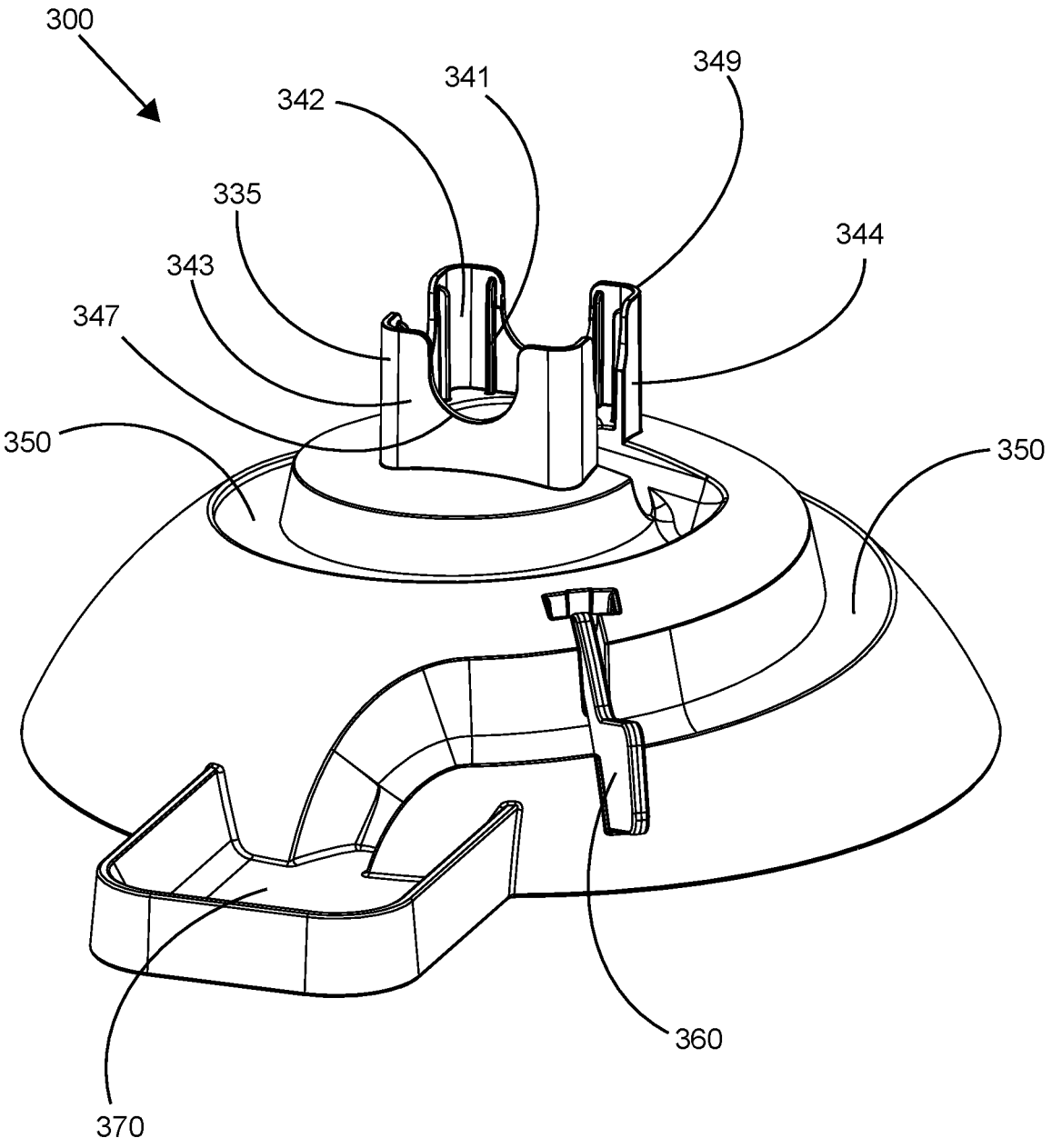
FIG. 28 illustrates a perspective view of the collector, in accordance with one embodiment.
Figure 29:
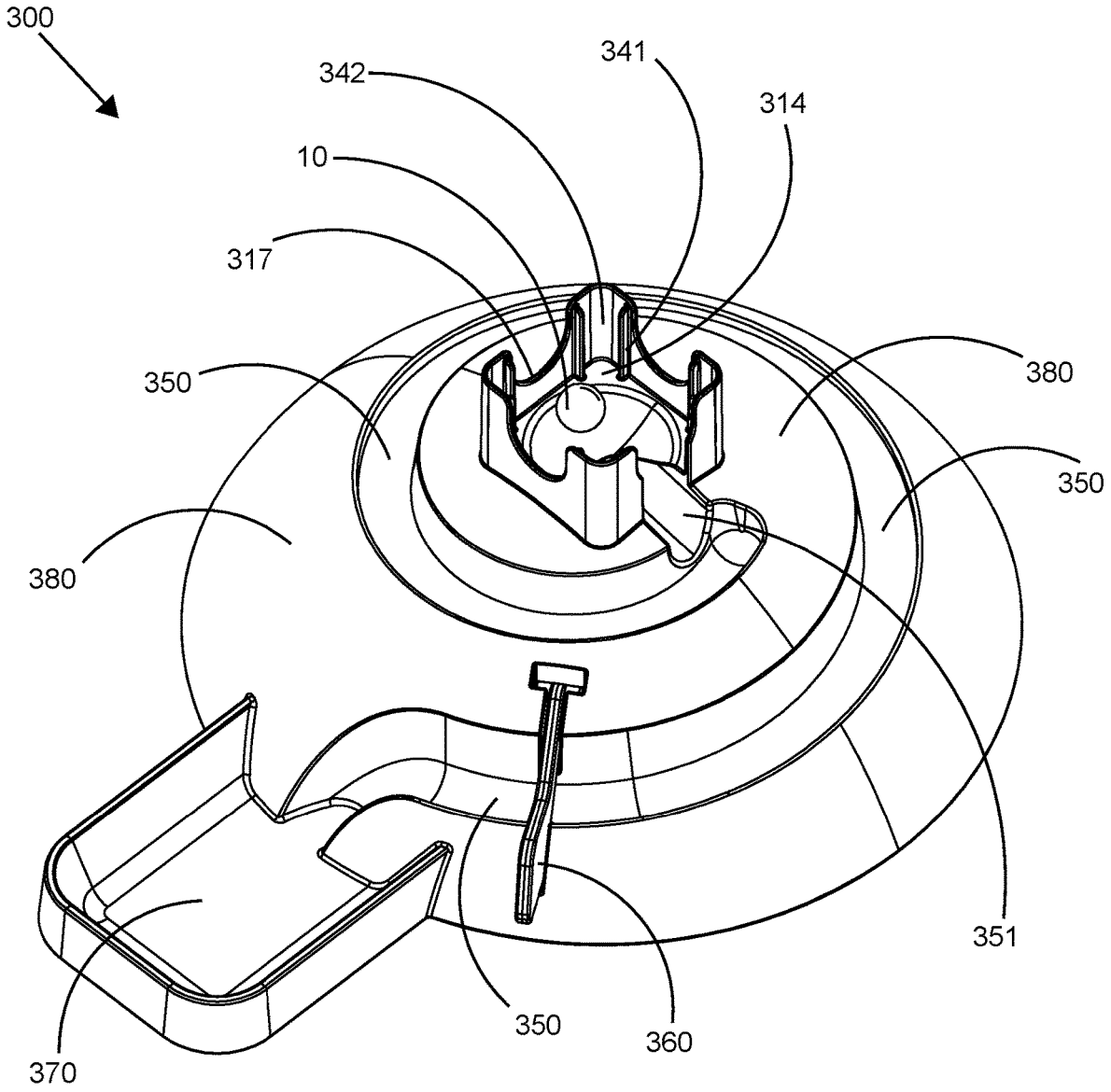
FIG. 29 illustrates another perspective view of the collector, in accordance with one embodiment.
Figure 30:
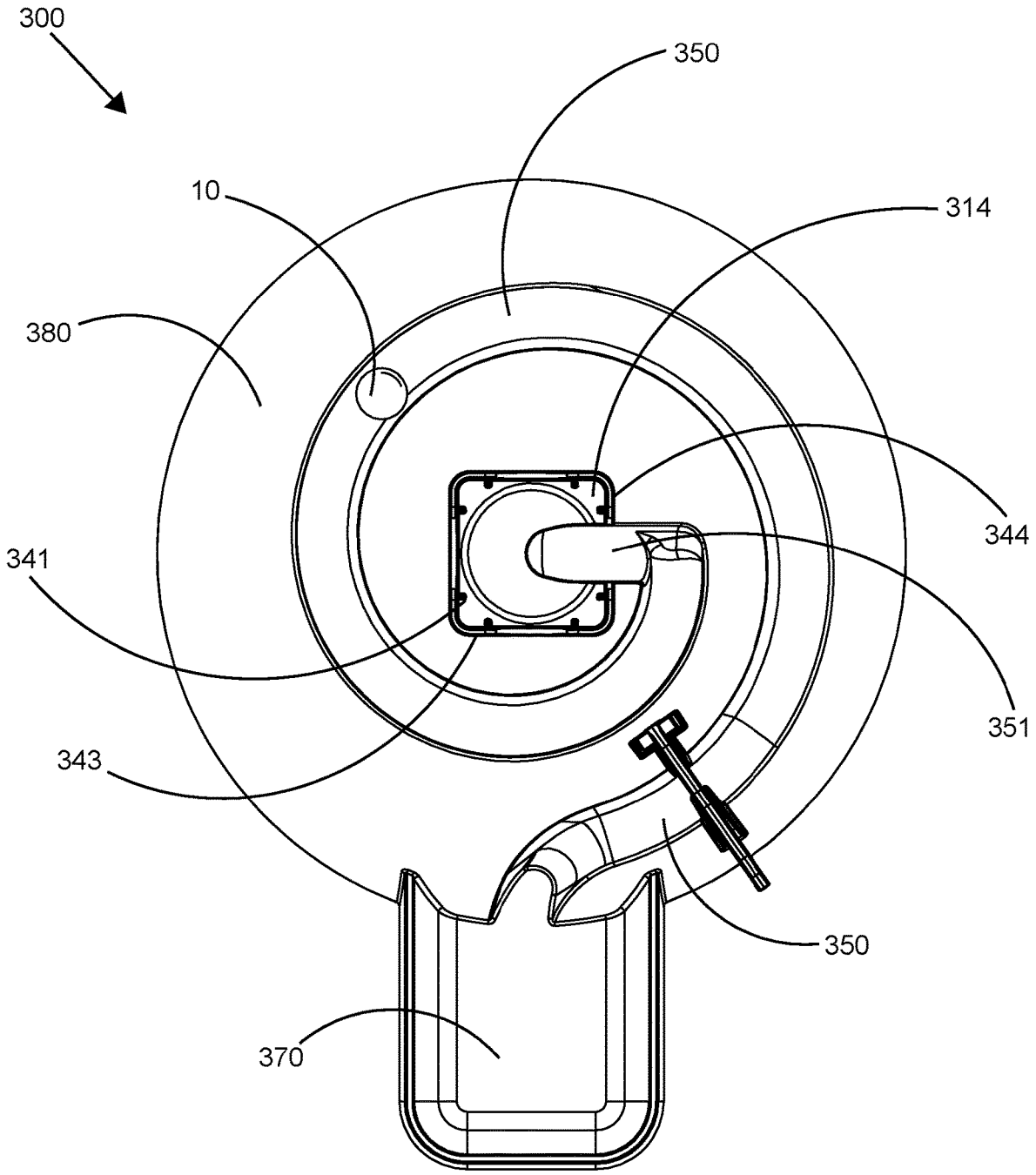
FIG. 30 illustrates a plan view of the collector, in accordance with one embodiment.
Figure 31:
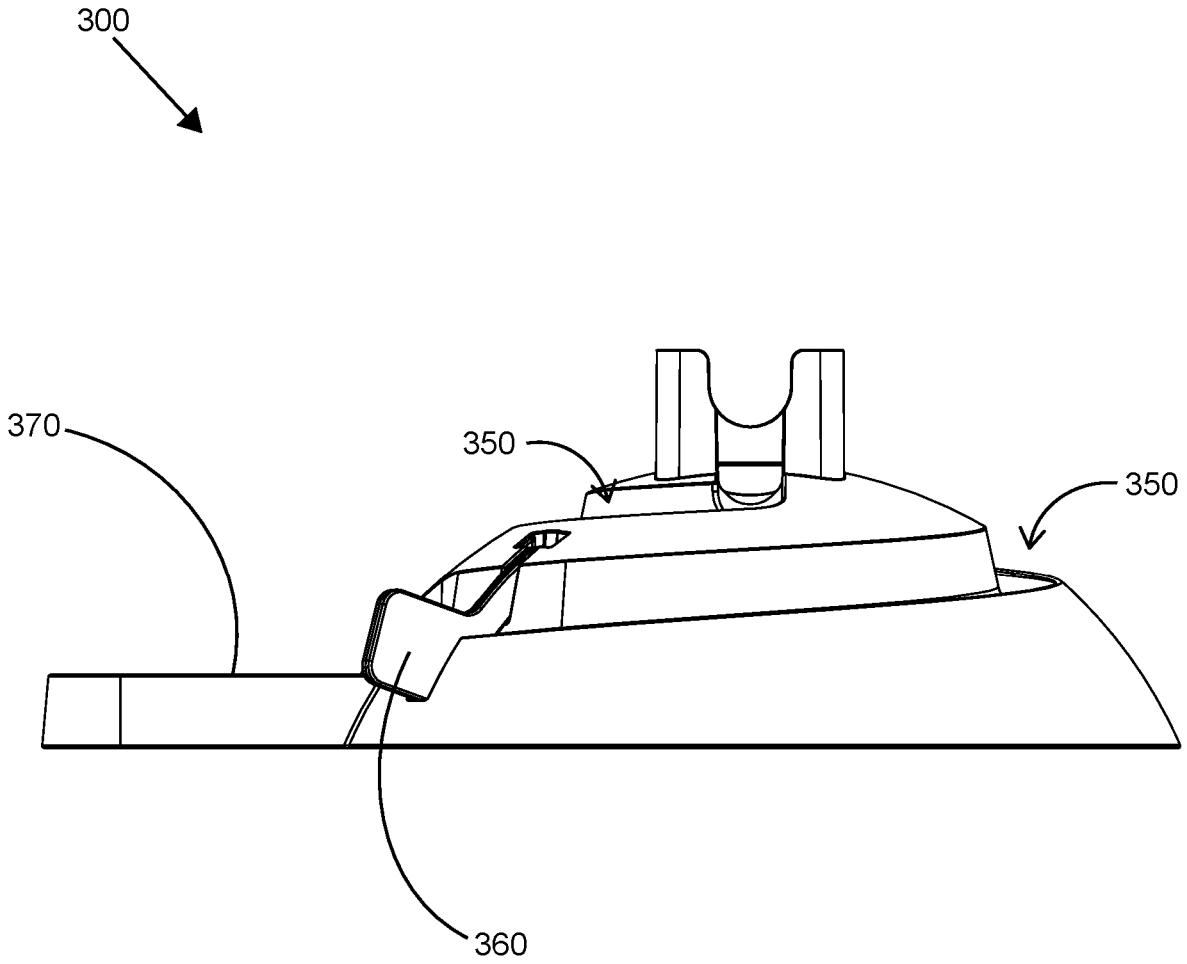
FIG. 31 illustrates an elevation view of the collector, in accordance with one embodiment.

The bottom legs of this male joint 230 in FIG. 19 nest against the female joint surfaces 342 as seen in FIGS. 28 and 29 and also against female joint surfaces 941 or 942 as seen in FIG. 5 or 7. The legs of this male joint 230 are configured to extend down to and rest upon a floor surface 914 or 934 of a modular cube member as in FIG. 5 or 7 or a corresponding floor surface 314 inside the joinery on top of a collector 300 as seen in FIG. 29. Line tuning on the upper outside corners of the legs of this male joint 230 may secure a tight fit with the corresponding female part it encounters within a modular cube 910 or 930 or a collector 300 or other accessory component of this modular construction system.

Figure 22:
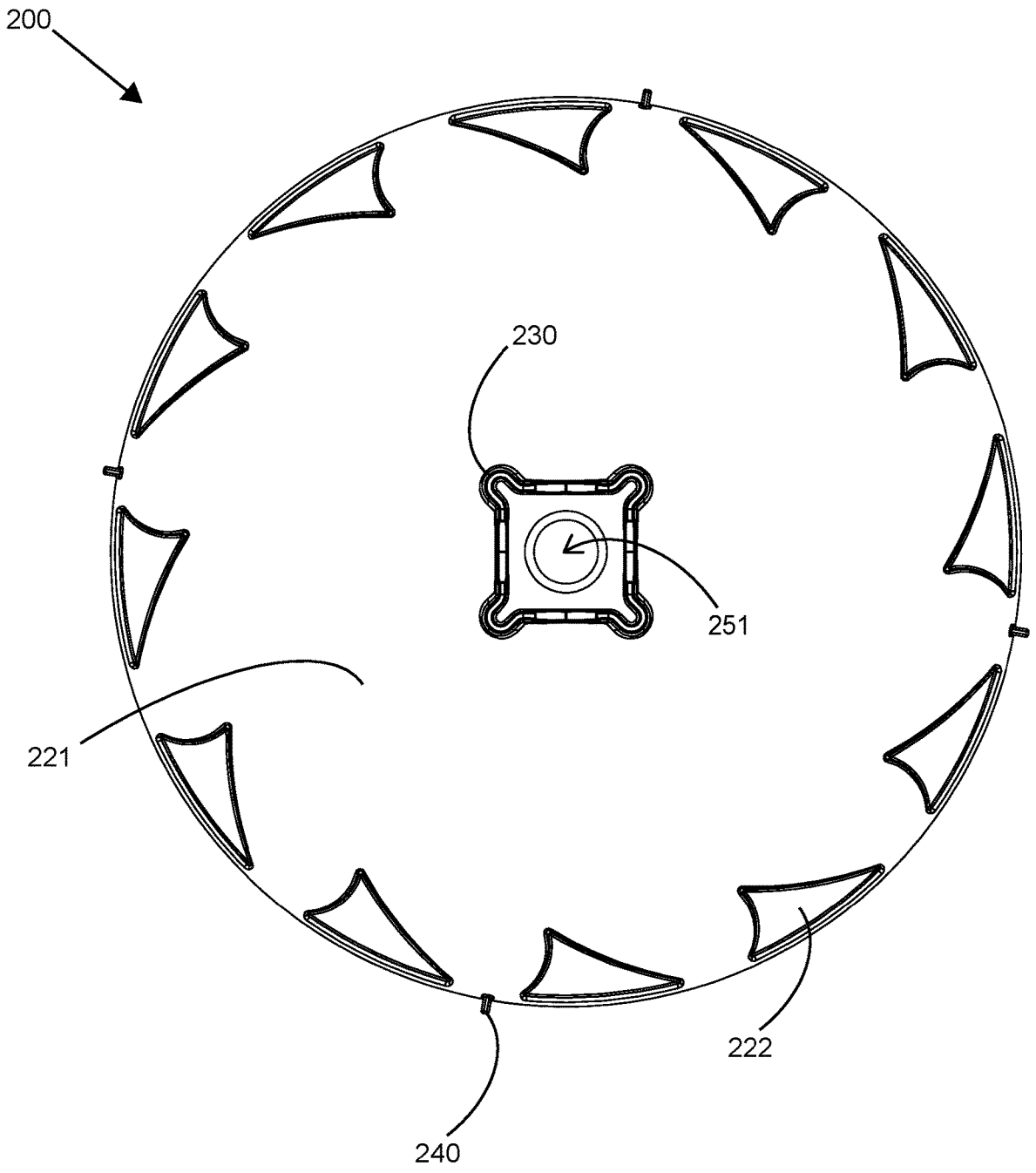
FIG. 22 illustrates a bottom view of the second component, in accordance with one embodiment.

The circular exit opening can be seen in the center surrounded by the roughly square male joinery geometry in FIG. 22. The roughly triangular forms 222 arrayed around the perimeter are the undersides of the starting platforms 201. There are four small protrusions 240 extending beyond the perimeter of the second component 200. These are stops that engage with the first component and control the extent of the rotation of the first component clockwise and counter-clockwise. Surface 221 is the bottom face of the sloping surface 222 down which the marbles roll.

With geometrically repeated start platforms 201 that are the same for each marble (or sphere) radially arrayed around a central exit 251, and with equality for the slope and form of the funnel-like surface 220 for each marble from start platform 201 to exit 251, there is an equality and a fairness to the start of a race using second component 200. There is no advantage to one starting position 201 over another when all of the positions are filled. With this circular or perimeter starting line, as long as each starting position is filled with a marble, every marble is equally spaced between two other marbles. The jostling for position right from the start of the race has equality and fairness. This is an advantage over a straight starting line in which the marbles at the ends have only one neighbor and the interior marbles each have two neighbors and the marbles at the ends have a longer distance of travel to the exit opening than those in the middle of the straight starting line.

Part of the game play with a race set can include running multiple races in a row and recording the results toward declaring a champion or an overall ranking for a whole series of races. The fairness and equality at the start which comes from the circular or perimeter starting line removes the aberrations that result from a standard linear starting line as discussed above. With the circular or perimeter starting line there is no need to adjust starting positions for sequential races in a series of races using a handicapping system to calculate which starting lane each participant (marble) should have.

The player or user of second component 200 may also be curious about what the introduction of asymmetries may yield. Second component 200 may afford this experimentation by allowing the player to use less than all of the starting positions during any run of the race. The player may proceed experimentally by introducing asymmetries such as using only some of the starting positions, such as just nine of the twelve starting positions 201, leaving a gap of three marbles. This causes there to be a leading marble and a trailing marble in the clock-wise flow of marbles down the exit surface 220. Alternatively, two groups or teams of marbles, such as for a total of six participants, may be placed on opposite sides of second component 200, point symmetrically arranged with respect to the exit opening 251. Such an arrangement leaves gaps of three marbles between the leading and trailing marbles of each team. The player who is operating the second component 200, by paying attention to the results of a series of races, can see how the leading, trailing or middle marbles of either of the two teams of marbles is impacted by the asymmetry.

Marble Choreography. The artful and intentional loading of marbles onto the sloping surface 220 that leads to an exit 251, or leads to a larger exit that allows the passage of multiple marbles simultaneously, is marble choreography. A choreographed flow of a plurality of marbles on the sloping surface 220, may be intentionally chaotic and haphazard in appearance. Alternatively, the choreographed flow may include the marbles flowing downward on separate but congruent paths rotationally offset from one another with respect to the center of curvature of the sloping surface 220. A marble flowing down the sloping surface may spiral around the exit opening 251 in a spiral manner. A second marble flowing down simultaneously, having started from a rotationally offset starting position 201, and the first marble will come closer and closer together as they near the exit 251. A set of twelve marbles, for example, launching simultaneously from starting positions 201*a*, 201*b*, 201*c*, 201*d*, 201*e*, 201*f*, 201*g*, 201*h*, 201*i*, 201*j*, 201*k*, and 201*m*, depending partly upon the sectional profile of the sloping surface 220, as can be seen for one embodiment in FIG. 24, will spiral downward and come closer and closer to one another making a tighter and tighter circle that becomes more apparent as the marbles get closer and closer together. They may then collide and deflect out of a perfect circular formation, due to slight variations in their respective paths introduced for example by some slight difference in how they were nudged out onto the sloping surface, the asymmetry introduced upon impact and deflection then sets in motion a process by which the order of exit out the exit 251 is established. A feature of the present invention is how physical characteristics of the sloping surface 220 allow this choreography in which the marbles roll downward in unison and in formation and then break formation as they jostle for position at the exit opening 251. This choreography which transitions from smooth elegant unison to the jostling exit creates a moment for aesthetic appreciation of the beauty of the flow and also a moment of anticipation watching the formation of marbles spiraling down ahead of the collision of the twelve marbles. Alternatively, the exit opening 251 can be wide enough that the twelve marbles (or other number of marbles) spiraling in unison in circle formation are able to remain in circle formation all the way through the exit opening. In such a case, the marble may rotate faster and faster as they reach the edge of the exit opening and explode down to the next stage of the race below to whichever member or set of members is in place to catch them.

Some embodiments of the present disclosure may include twelve starting positions 201, but other embodiments could have more or fewer starting positions without departing from the principles of the invention. Using the twelve starting positions of the second component 200 in various combinations, however, is a way to illustrate the many different ways a user may experiment with marble choreography by selectively using some starting positions and not others in the embodiment shown for example in FIG. 3 or 12. With reference to FIG. 21, a user could load marbles into starting positions 201*a*, 201*e* and 201*i* and form an equilateral triangle of marbles. These marbles flowing down the sloping surface 220 could spiral down into a tighter and tighter circle pattern, depending on their velocity and the cross-sectional shape of the sloping surface 220, until they collide or exit in unison as described above. A user could load marbles into starting positions 201*a*, 201*d*, 201*g* and 201*j* and form a square of marbles which may be launched to similar effect as described above for the triangle. In both examples, in this embodiment, the centers of both this equilateral triangle and the square are centered over the exit opening 251. An isosceles triangle starting formation of marbles can be made by using starting positions 201*a*, 201*f* and 201*h*. The exit 251 is under the area of this isosceles triangle, but the marbles are not equidistant from one another around the perimeter and so will not be equidistant as they near one another at the exit. In the small exit opening embodiment, when they collide, there will be lead and trailing marbles. Part of the play or the experimental mindset a user may employ in loading this isosceles triangle pattern of marbles is to see if there is a tendency of any of the three marble positions to be the past of first one out the exit. Another possibility is a flattened triangle that can be made using starting positions 201*a*, 201*c* and 201*e*.

The area formed by this flattened triangle is off to one side of the second component 200 and not directly over the exit 251. This is another choreographed pattern made possible by various embodiments of the present invention. Another embodiment could make it so that only patterns of this nature are possible. In such embodiments only patterns like this that are not directly over the exit 251 are possible. Such patterns have an area described, in plan view, by the plurality of marbles being off to the side and not directly over the exit 251. Even so, such an embodiment still exhibits the characteristics of marble choreography and does not depart from the scope of the present invention.

The cross-sectional shape of the sloping surface 220 may be formed and the acceleration and speed of the marbles upon the sloping surface tuned to maximize dwell time of the marbles rotating and/or rolling on the sloping surface. Some embodiments of the invention may include a spring release mechanism or other means of accelerating the marbles besides gravity alone and remain within the scope of the invention.

A player may experiment with marbles at the start in various ways. They can place all marbles uniformly around the perimeter, or place every other marble leaving alternate start positions empty, or place half the marbles clustered so that one half of the perimeter is empty of marbles at the start, or can load marbles in one section such as one quadrant and an opposite section such as an opposite quadrant leaving two empty sections such as quadrants and thus multiple empty start positions between two groupings of marbles, or can load three sections such as three quadrants fully while leaving one section such as one quadrant empty. In the case of marbles flowing at the start in a clockwise or counter-clockwise direction around and down toward a central choke point or exit, some configurations such as the three-quadrant configuration creates a lead marble and a trailing marble with a gap in between. This and other asymmetries may be experimentally tested to see the impact, to see the difference between uniform and non-uniform marble flows at the start of the race, to see how the various marbles may gain or lose advantage with these different configurations.

The fins 202 which guide the motion of marbles as they begin their descent on the sloping surface 220 may be of varying curvatures and/or lengths in plan view. In some embodiments, a marble flowing down the surface 220 may accelerate as it nears the exit 251, but rather than continuing a uniform descent down toward the exit, the acceleration may carry the marble first, further away from the center in more of an elliptical than a circular or ever-tightening spiral path. And in some such embodiments the marble after travelling back up the sloping surface may collide with a fin, stalling its motion and leading to a more direct exit of the marble down the sloping surface to the exit 251 after this collision with the fin has decelerated the rotational velocity. In such an embodiment, the fin has this secondary function of acting as a deflector. Other deflectors may also be added in other embodiments. The presence of deflectors which disrupt the rotational motion, the spiral motion around the center do not depart from the scope of the invention.

Collector FIGS. 28-33 show an embodiment of the collector 300 or finish tray. It includes a long spiral track 350 along which marbles align in ranked order of their finishing the marble run racecourse above. A moveable stopper 360 interrupts the flow of marbles down the track 350, stopping the marbles in a line so their order may optionally be viewed and/or recorded. The stopper is hinged and can be rotated up out of the track allowing the marbles to roll out of the track and down into a retrieval tray 370.

Figure 13:
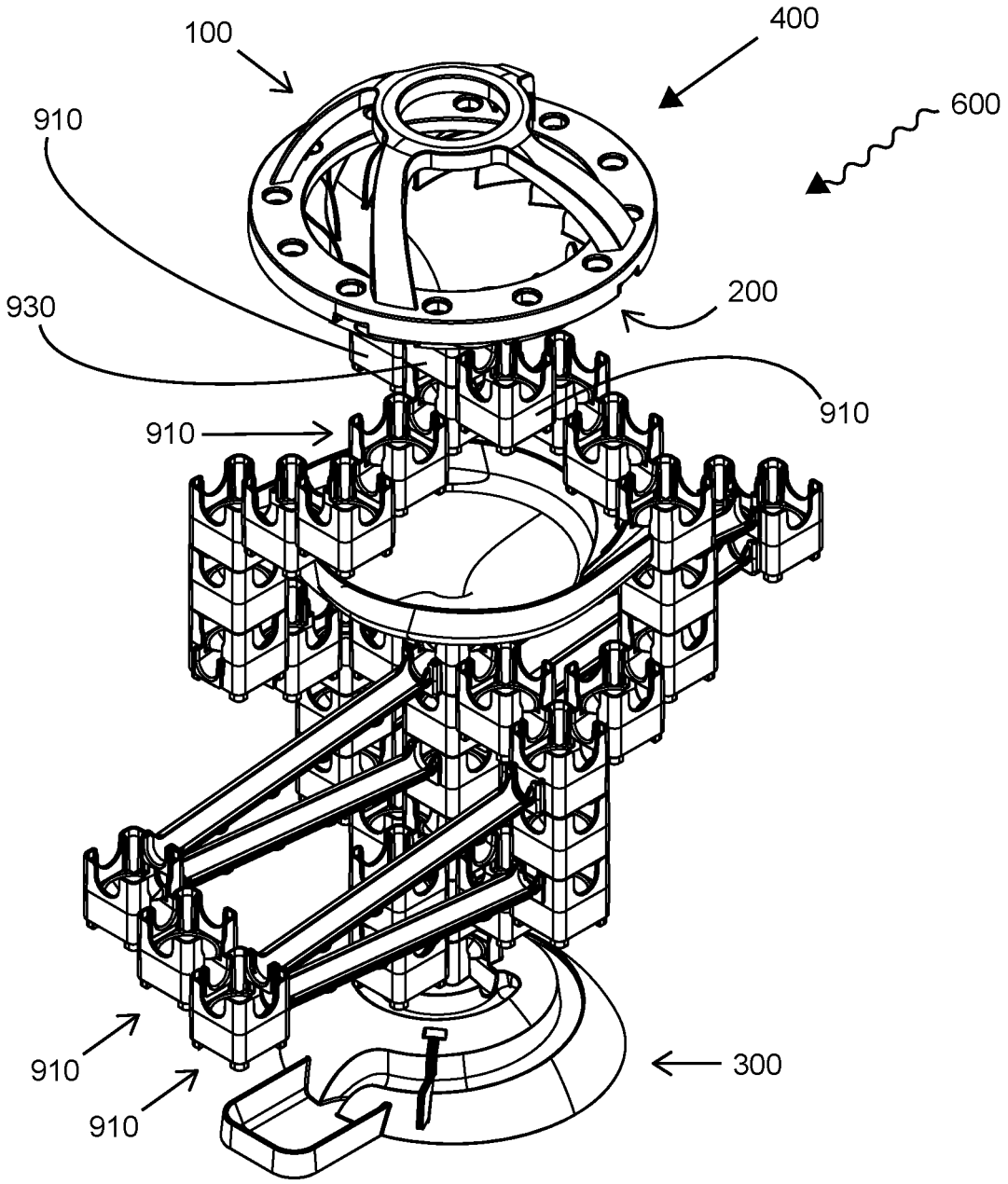
FIG. 13 illustrates a perspective view of the same configuration as in FIG. 12 of the starter assembly and the collector together with cubes and accessories of the modular pathway apparatus, in accordance with one embodiment.

The embodiment of the collector shown in FIGS. 28-33 also acts as a sturdy base to support an assembly of members above such as the configuration 600 FIGS. 12 to 14. The overall form of this collector base 300 is a partial sphere, the base surface 380 is a surface of rotation formed by an arc FIGS. 31 to 33. In plan view FIG. 30, the base surface 380 has a circular perimeter with the retrieval tray 370 attached. The collector base 300 in some embodiments may be close to five times the width of a single modular cube 910 FIG. 10. The width of this collector base provides resistance to overturning. Structures made using the modular cubes, rails and stunt pieces may cantilever far out to one side, or several sides as in FIGS. 10 to 14. The collector base may be helpful for providing stability to such cantilevering structures. A tall structure may be built on top of this collector base and receive added stability. Various details of the design of the collector base may confer this stability.

In the embodiment shown, at the top center of the collector base 300 is a joinery portion 335 integrally molded into the part that matches the form and details of the top of a single-exit cube 910, thus components, accessories and joinery designed to couple with the top portion of a single-exit cube 910 may also couple with a collector base 300 via the joinery portion 335. The vertical support rib 341 of the collector base 300 performs a similar stabilizing function as the vertical support rib 911 of a single-exit cube FIG. 4, resisting rotational movement of any male joint of a modular cube member engaged with the rib.

Since a modular cube member such as the single-exit cube 910 has five connection points for other cubes (and other parts that use this joinery system) in this example, this collector base with its integral cube top also has these five connection points: one on each of the four sides 343 and 344 of the joinery portion 335 and one on top 349. Three faces 343 of the joinery portion 335 contain U-shaped cube female joints which also serve as marble entrances 347. One face 344 of the joinery portion 335 has a unified opening. This unified opening serves as both an entrance and an exit: an entrance for marbles passing into the chamber between the four faces of the entry portion 335 and an exit for marble passing out of the chamber through the exit face 344 and down onto the track 350. A sloping exit pathway 351 runs from the interior chamber to and through exit face 344 of the chamber. This exit pathway 351 leads beyond the chamber to the top of the track 350 that winds around and away from the joinery portion 335, circling the joinery portion 335 more than once in a clockwise direction. FIGS. 9 to 14 show examples of modular cubes connecting to the joinery portion 335. The joinery portion 335 may also accept the male joint 230 of the starter accessory FIG. 3

The vertical support ribs 341 resist rotation of a connected modular cube 910 in the vertical plane of the adjacent face 343. The face 343 or 344 resists rotation of a connected modular cube 910 in the vertical plane perpendicular to such face. This resistance to rotation in two perpendicular planes transfers the stability of the collector base 300 from the floor and up into the members interlocked above FIGS. 11 and 12.

Figure 32:
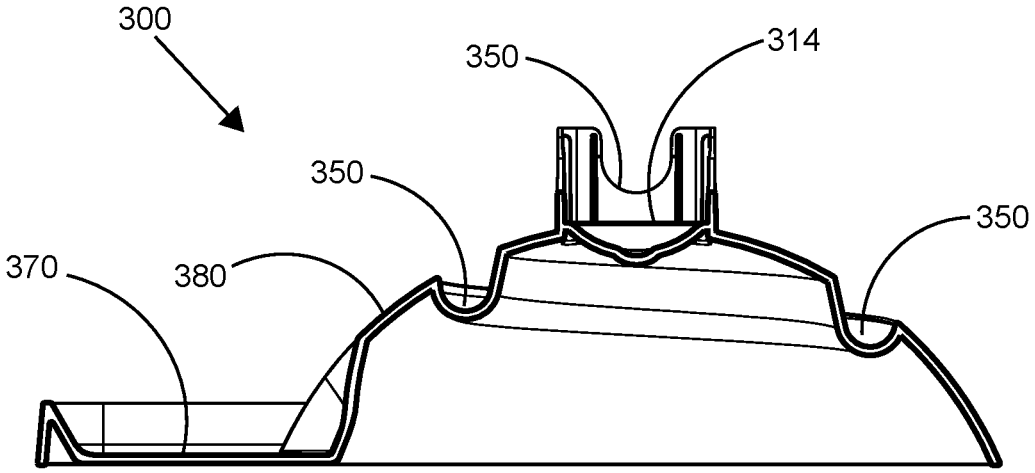
FIG. 32 illustrates a cross-section view of the collector, in accordance with one embodiment.
Figure 33:
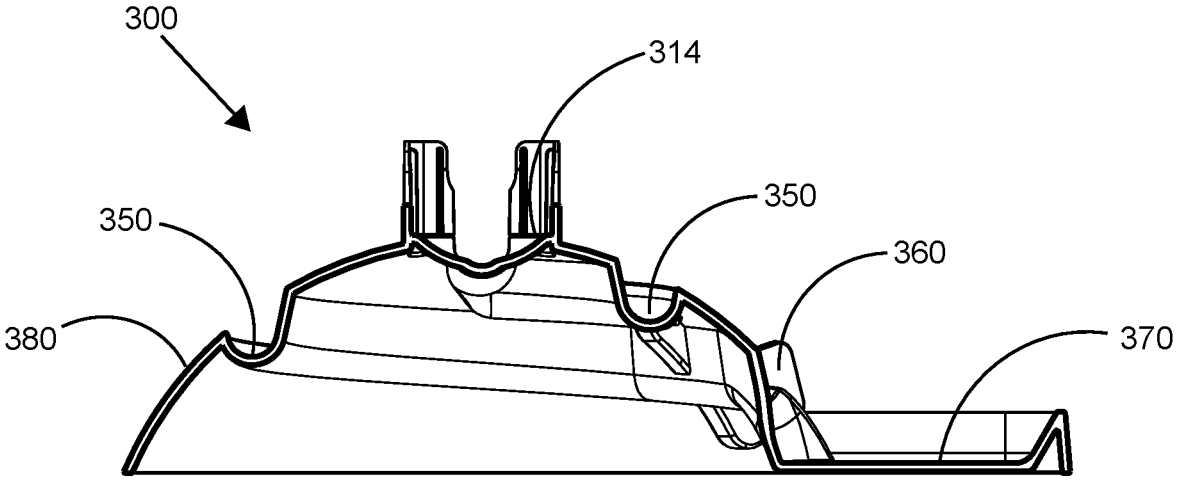
FIG. 33 illustrates another cross-section view of the collector, in accordance with one embodiment.

The spiral track 350 may be inset deep enough into the base surface 380 to create side walls sufficient for holding rolling marbles in place as seen in FIGS. 32 and 33. The cross-section through the spiral track 350 shows that the bottom surface of the ramp is curved, mimicking the form of a sphere or marble. Near the far bottom end of this spiral track 350 is a moveable stop 360. This stops the motion of a marble (or other spherical object which could be made of glass, metal, wood, rubber, plastic) which has rolled onto the spiral track 350. Subsequent marbles will line up behind a first marble on the spiral track 350 which is of a width to force the marbles into a single-file line showing the sequence of arrival of the marbles.

If twelve marbles started in a racecourse above and rolled down to this collector base, then, with the stopper activated, the twelve marbles are stopped and lined up in the order of their finishing the race. In this embodiment, the stop 360 is a hinged gate. The stop 360 may be lifted or removed in order to allow the marbles which have been lined up to roll further down into the retrieval tray 370 beyond and below the stop location.

The embodiments shown here are designed to work with the cubes of FIGS. 4 to 7 and to work with the grid system of these cubic members, the shifted cartesian spatial grid. The top 349 of the joinery portion 335 of the collector base 300 is at a height such that it aligns with an adjacent stack of cubes built from the same floor level on which the collector base rests. The top 349, FIG. 28, is two modular cube units high plus the height of the bottom pegs of the floor-level cube (the bottom pegs not counting in the "height" of a cube since, when two of these modular cubes are stacked, the bottom-peg height of an upper cube is swallowed/absorbed by the lower cube.)

In other embodiments of the collector 300, rather than having an integrally molded joinery/entrance for marbles, the collector could be devised to accept any of the modular cubes to provide the joinery/entrance. In such embodiments, marbles may enter a geometry similar to a quad-exit cube or a series of two double-exit cubes. This provides a random distribution of marbles, which would lead, in some circumstances, for some destinations to receive more marbles than another. To keep such embodiments fair, the parts with multiple exits would need to be kept level to avoid a bias in favor of one exit over another.

Switches in the collector may divide a single pathway into two, four, eight, less or more pathways. One path may bet split in two twice to make four destinations, for example. Mechanical switches that alternately send marbles to one path or another in the order received can accomplish this splitting of pathways. The switches may be configured such that alternate marbles arriving at the switch are sent onto first one pathway and then the other such that, with any even number of marbles, half would be directed one way and half the other. There can also be a means of scrambling the switches ahead of a run of the race and the switches may be hidden from view so that this final sorting of marbles at the end is itself a mystery.

In embodiments in which all four sides of the integral joinery on the top of the collector have exits, then rather than seeing a single finish line, there may be four finish positions. Different game values and results could correspond to a particular marble (perhaps differentiated from other marbles by its color or material) ending up in one of the more than one finish destinations.

Alternatively, the collector base could have a pocket to receive a cube rather than having a cube-like portion integrally molded in.

The collector base could be made of injection molded plastic or rubber, for example. It may also be made of a solid block of wood or rubber or other suitable material, such as to give it greater weight to add to its overturning resistance function.

The stopper 360 could alternatively be a large single marble placed in a pocket overlapping the spiral ramp pathway. Alternatively, the stopper 360 could be composed of two or more marbles of the same size as the racing marbles set into a pocket suitable to receive these two or more marbles such that the cluster of marbles act as a stop for the racing marbles.

In some embodiments of the present invention, spheres or marbles may be released from a starting perimeter and rather than proceeding to one single lane pathway and the marbles may be diverted to various distinct pathways. There is just one winning position and all other marbles remain in a non-ranked grouping. Alternatively, there could be several winning positions with extra marbles remaining in a non-ranked grouping.

Other embodiments of this collector base may not use or include the spiral ramp finish line. Marbles may collect under the collector base, or around the perimeter of the collector base, or in various pockets or destinations on the collector base, or marbles could roll out of any number of exit holes around a lower portion of the collector base. No matter how the marbles collect in, on or under the collector base, in various embodiments the collector base may also be useful for the stability it provides.

Modular Cubes. The following patents and applications are incorporated herein in their entirety: U.S. Pat. No. 8,475,226, application Ser. No. 11/406,824, entitled, INTERCONNECTING MODULAR PATHWAY APPARATUS, filed Nov. 18, 2006; U.S. Pat. No. 9,409,097, application Ser. No. 13/940,166, entitled, ACCESSORIES TO A MODULAR PATHWAY APPARATUS, filed Jun. 11, 2013; U.S. Pat. No. 11,117,067, application Ser. No. 15/694,335, entitled, INTERCONNECTING MODULAR PATHWAY APPARATUS, filed Sep. 1, 2017; and U.S. application Ser. No. 17/388,485, entitled, INTERCONNECTING MODULAR PATHWAY APPARATUS, filed Jul. 29, 2021. Embodiments disclosed in the foregoing applications and patents may be used in connection with embodiments of the present disclosure. In other cases, other components and/or accessories may be used or also used with embodiments of the present disclosure.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A launcher for a race game, the launcher comprising:

a bowl that includes a dedicated starting position for each of at least three orbs;

the bowl having an inner surface and an outer surface, the inner surface defining a bowl shape;

wherein the bowl has an opening in the inner and outer surfaces that is large enough for the at least three orbs to fit through one at a time;

wherein three of the starting positions together form the points of a triangle in plan view;

and wherein the opening is lower than a horizontal plane of the lowest point of the triangle.

2. The launcher of claim 1, further comprising at least three dedicated starting positions that together form three points of a triangle in plan view, wherein the opening is within the triangle in plan view.

3. The launcher of claim 2, wherein triangle is an equilateral triangle in plan view.

4. The launcher of claim 3, wherein the opening is centered under the equilateral triangle in plan view.

5. The launcher of claim 1, further comprising at least three dedicated starting positions that form three points of a triangle in plan view, where the opening is not within the triangle in plan view.

6. The launcher of claim 1, wherein the bowl is a vortex.

7. The launcher of claim 1, wherein the bowl is a cone.

8. The launcher of claim 1, wherein more than one orb can fit through the opening at a time.

9. A launcher for a game, the launcher comprising:

a first portion that includes a dedicated starting position for each of at least three orbs;

a second portion attachably coupled below the first portion, wherein the second portion has an inner surface and an outer surface, the inner surface defining a bowl shape;

wherein the second portion has an opening in the inner and outer surfaces that is large enough for the at least three orbs to fit through one at a time; and wherein three of the starting positions together form the points of a triangle in plan view.

10. The launcher of claim 9, further comprising a path of the same distance from each of the dedicated starting positions to the opening.

11. The launcher of claim 9, wherein the opening is within the triangle in plan view.

12. The launcher of claim 9, wherein the plan view triangle is equilateral.

13. The launcher of claim 12, wherein the opening is centered under the plan view equilateral triangle.

14. A randomizer for game play, the randomizer comprising:

a bowl communicably coupled to one or more finish pathways that lead to at least three finish positions, the bowl including a dedicated starting position for each of at least three orbs;

the bowl having an inner surface and an outer surface, the inner surface defining a bowl shape;

the bowl having an opening in the inner and outer surfaces that is large enough for the at least three orbs to fit through one-at-a-time; and wherein the at least three dedicated starting positions together form three points of a triangle in plan view; and wherein the one or more finish pathways that lead to at least three finish positions includes a finish position for a first-arriving orb.

15. The randomizer of claim 14, wherein a single finish pathway displays the at least three orbs in the order in which they arrive.

16. The randomizer of claim 14, wherein the opening is within the triangle in plan view.

17. The randomizer of claim 16, wherein the opening is centered under the triangle in plan view.

18. The randomizer of claim 14, wherein the opening is not under the triangle in plan view.

19. The randomizer of claim 14, further comprising at least one modular member detachably connected in between the bowl and the finish pathway.

20. The randomizer of claim 19, wherein the finish pathway is formed in a base that is at least four times the width of the at least one modular member.

* * * * *